US011701560B2

(12) United States Patent
Chavez

(10) Patent No.: US 11,701,560 B2
(45) Date of Patent: Jul. 18, 2023

(54) HEIGHT-ADJUSTABLE GOLF TEE SYSTEM

(71) Applicant: Practice Perfect Golf Solutions, LLC, Seattle, WA (US)

(72) Inventor: John Chavez, Seattle, WA (US)

(73) Assignee: Practice Perfect Gold Solutions, LLC, Seattle, WA (US)

( * ) Notice: Subject to any disclaimer, the term of this patent is extended or adjusted under 35 U.S.C. 154(b) by 0 days.

(21) Appl. No.: 17/195,525

(22) Filed: Mar. 8, 2021

(65) Prior Publication Data

US 2022/0323838 A1 Oct. 13, 2022

(51) Int. Cl.

| | |
|---|---|
| ***A63B 57/00*** | (2015.01) |
| ***A63B 57/15*** | (2015.01) |
| ***A63B 57/13*** | (2015.01) |
| ***A63B 69/36*** | (2006.01) |

(52) U.S. Cl.

CPC ..... *A63B 57/15* (2015.10); *A63B 57/13* (2015.10); *A63B 69/3661* (2013.01)

(58) Field of Classification Search

CPC ..... A63B 57/15; A63B 69/3661; A63B 57/13
USPC ..... 473/278, 387–403
See application file for complete search history.

(56) References Cited

U.S. PATENT DOCUMENTS

| | | | | |
|---|---|---|---|---|
| 1,625,911 | A * | 4/1927 | Richards | A63B 57/10 473/398 |
| 3,633,919 | A | 1/1972 | Liccardello et al. | |
| 4,905,999 | A | 3/1990 | Voinovich et al. | |
| 5,248,144 | A * | 9/1993 | Ullerich | A63B 57/15 473/279 |
| 6,062,989 | A | 5/2000 | Wagner et al. | |
| 6,086,486 | A | 7/2000 | Murphy et al. | |
| 6,110,060 | A | 8/2000 | Spoto | |
| 6,328,663 | B1 | 12/2001 | Lipstock | |
| 6,729,977 | B1 | 5/2004 | Young et al. | |
| 6,942,583 | B2 | 9/2005 | Syu | |
| 6,958,021 | B1 | 10/2005 | Gustine | |
| 7,052,416 | B2 | 5/2006 | Chang | |
| 7,086,972 | B2 | 8/2006 | Bainbridge et al. | |
| 7,094,163 | B2 | 8/2006 | Lu et al. | |
| 7,604,554 | B2 | 10/2009 | Otsubo | |

(Continued)

FOREIGN PATENT DOCUMENTS

KR 200435131 Y1 1/2007

OTHER PUBLICATIONS

The Groove RT, Adjustable Height Range Tees for Mats, URL= https://www.amazon.com/Groove-adjustable-range-tees-yellow/dp/B0033W2OVA, accessed: Mar. 9, 2021, 5pgs.

(Continued)

*Primary Examiner* — Nini F Legesse
(74) *Attorney, Agent, or Firm* — Knobbe, Martens, Olson & Bear, LLP

(57) ABSTRACT

An adjustable height golf tee system having a tee and an anchor is discussed. The tee is height-adjustable relative to the anchor. A first anchor includes a cap, a stem, and a tip. The stem can be threaded internally, externally, or a combination thereof. A second anchor includes a base, a first stem, a cap, and a second stem as well as optional spacers. The stems can be threaded internally. Both the first and second anchors can be composed multiple pieces (e.g., a detachable cap, a detachable stem, or a detachable portion thereof) to provide access to an inner cavity of the respective stems.

18 Claims, 21 Drawing Sheets

(56) References Cited

U.S. PATENT DOCUMENTS

| | | | | |
|---|---|---|---|---|
| 7,699,722 | B1 | 4/2010 | Neu et al. | |
| 7,717,811 | B1 | 5/2010 | Merullo | |
| 7,815,529 | B2 | 10/2010 | Lee | |
| 7,846,044 | B2 | 12/2010 | Sagadevan | |
| 8,622,853 | B1 | 1/2014 | Roland | |
| D705,877 | S | 5/2014 | Humphrey | |
| D705,878 | S * | 5/2014 | Humphrey | D21/717 |
| 8,968,118 | B2 | 3/2015 | Black, Jr. et al. | |
| 9,339,706 | B2 | 5/2016 | Black, Jr. et al. | |
| D760,332 | S | 6/2016 | Black, Jr. et al. | |
| 9,561,415 | B2 * | 2/2017 | Rost | A63B 69/3623 |
| 9,737,773 | B2 | 8/2017 | Ciasullo | |
| 10,173,115 | B2 * | 1/2019 | Rost | A63B 57/10 |
| 2005/0026726 | A1 | 2/2005 | Barouh | |
| 2006/0105859 | A1 * | 5/2006 | Thirkettle | A63B 57/10 473/387 |
| 2006/0199669 | A1 | 9/2006 | Barouh | |
| 2008/0039238 | A1 * | 2/2008 | Lee | A63B 57/15 473/400 |
| 2008/0102988 | A1 * | 5/2008 | Sagadevan | A63B 57/10 473/397 |
| 2009/0088274 | A1 * | 4/2009 | Blais | A63B 57/10 473/398 |
| 2009/0325726 | A1 | 12/2009 | Humphrey | |
| 2010/0075782 | A1 | 3/2010 | Stiles | |
| 2010/0173730 | A1 | 7/2010 | Iacono et al. | |
| 2012/0046121 | A1 | 2/2012 | Schubert | |

OTHER PUBLICATIONS

Keyfit Tools, Anchor Golf Range Tees for Driver 3 1/4 Inch~Screw In Tee So They Don't Launch Out Into The Range, Stop Looking, Chasing, Bending Over Stepping Out into the Range To Retrieve Your Tees, URL= https://www.amazon.com/Keyfit-Tools-Looking-Stepping-Retrieve/dp/B07X616NQC/ref=sr_1_1dchild=1 keywords=keyfit+tools+anchor+golf+range+tees+for+driver+3+1%2F4+inch qid=1615321299 sr=8-1, accessed Mar. 9, 2021, 5pgs.

Sanha Adjustable Tee, URL=https://www.amazon.com/Sanha-SANHA-TEE-Adjustable-Golf-Tee/dp/B00DC2X8MA, accessed Mar. 9, 2021, 9pgs.

Sanha Adjustable Tee, URL=https://justritegolftee.com/, accessed Mar. 9, 2021, 1pg.

TwisTee Adjustable Golf Tees, URL=http://www.intheholegolf.com/TWISTEE/TwisTee-Adjustable-Golf-Tees-(4-pack).html, accessed Mar. 9, 2021, 3pgs.

Twisted Golf Tees, URL=https://www.twistedgolftees.com/, accessed Mar. 9, 2021, 2pgs.

Yatta Golf, TelosTee, URL=https://yattagolf.com/products/telos-golf-teesvariant=11677208313892, accessed Mar. 9, 2021, 7pgs.

* cited by examiner

HEIGHT-ADJUSTABLE GOLF TEE SYSTEM

BACKGROUND

Currently, golf tees used at any practice facility do not allow for ease or precision of height adjustment, which is paramount to effective practice. For example, current golf tees for use at a driving range with artificial grass mats to strike the ball from are available in a variety of heights. However, these heights are fixed based on the golf tees available. In other words, each golf tee has a singular height. Therefore, multiple golf tees are required to achieve multiple heights. There are traditionally three sizes available—low, middle, and high tee heights. To switch among the various tee heights, the golfer lifts the mat, pulls out the golf tee through a hole in the mat, inserts the golf tee having the desired height through the hole, then replaces the portion of the mat that was lifted or moved.

As another example, current golf tees for use at a driving range with natural grass to strike the ball from are typically the same tees used during a round of play. While a single tee could be used for multiple heights, each time the golfer is interested in striking a ball for practice they must bend down, insert a new tee, find the correct height, and place the ball on the tee.

On the golf course, different golfers have different ball height preferences during a drive and differences in ball height preferences may be nearly immeasurable. Consequently, each time a golfer inserts a tee into the ground, there is likely a variation in the height at which they are using.

What is needed is a more consistent golf tee system.

DETAILED DESCRIPTION

A golf tee system having a tee and an anchor is discussed. The tee is height-adjustable relative to the anchor. A first anchor includes a cap, a stem, and a tip. The stem can be threaded internally, externally, or a combination thereof. A second anchor includes a stem and a base. The stem can be threaded internally. Both the first and second anchors can be composed of three-pieces (e.g., a detachable cap, a detachable stem, or a detachable portion thereof) to provide access to an inner cavity of the respective stems.

For ease and clarity of discussion, ball height, tee height, or head height are relative to the ground on which the golfer is standing and from which the drive is occurring. However, ball height, tee height, or head height are not intended to be so limited based on relative distance to the upper most surface of an anchor or one or more absolute lengths, heights, or distances.

Figure 1A:
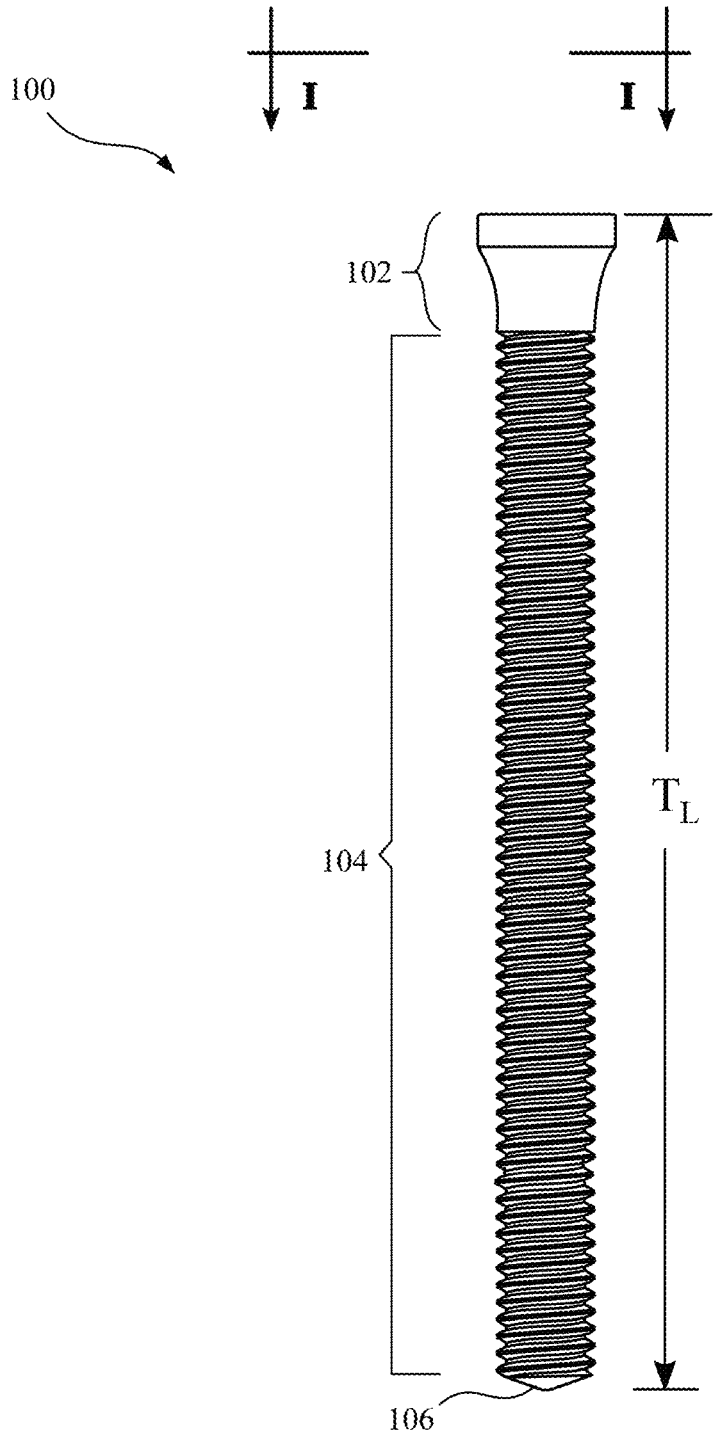
FIGS. 1A-1B illustrate an example tee.
Figure 1B:
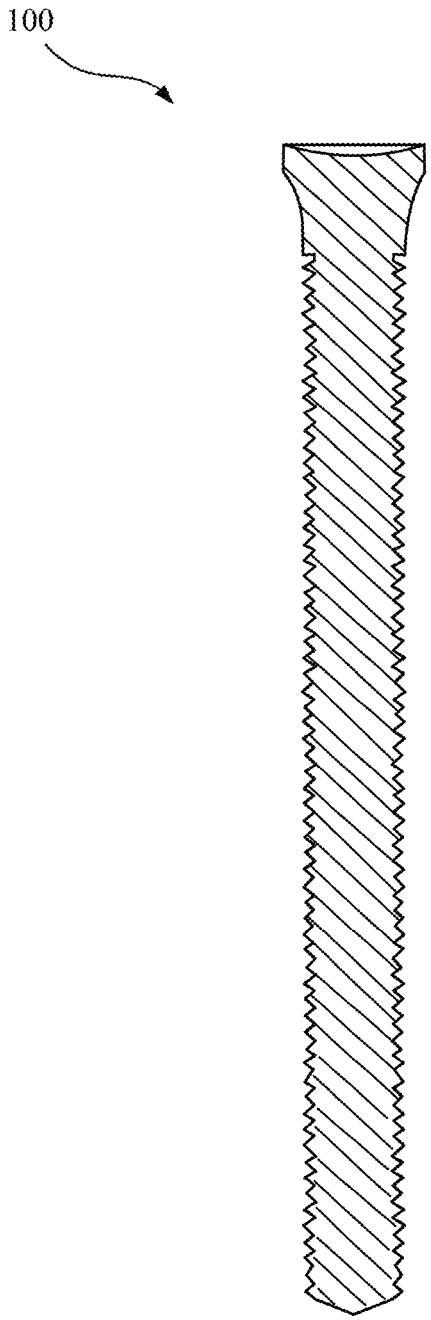

FIG. 1A shows a tee portion or tee 100. FIG. 1B shows a cross-sectional view of the tee 100 taken along the line 1-1. The tee portion 100 includes a shaft 104, a head 102 at a first end of the shaft 104, and a tip 106 at a second end of the shaft 104. The head 102 can be flat or concave. The tee portion length TL can be any appropriate size. For example, the tee portion length TL can range from 25.4-127 mm.

In one example, the tee portion length TL can be less than or equal to the sum of one-half a diameter of a golf ball plus the height of the largest legal driver head (i.e., tee length=(0.5 x (golf ball diameter))+(height of largest legal driver head)). Currently, an "American" golf ball, as determined by USGA equipment rules, can be no less than 42.67 millimeters in diameter. Alternatively, a "British" golf ball can be no less than 41.1 mm in diameter. Also, based on the current USGA equipment rules, the maximum distance from the sole to the crown of the club head is not greater than 71.12 mm.

The shaft 104 of the tee 100 can be threaded. The threads can be any appropriate size, including, without limitation, ranging from 1/64 inch (0.396875 mm) to 1 inch (25.4 mm), such as in increments of 1/64 inches (or, 0.396875 mm). The shaft 104 can include any appropriate number of threads, whether in total or in threads per inch, including, without limitation, 1, 2, 3, 4, 5, 6, 7, 8, 9, 10, 11, 12, 13, 14, 15, 16, 18, 20, 24, 32, 40, 50, 60, 70, 80, 90, 100, up to 2, up to 3, up to 4, up to 5, up to 6, up to 7, up to 8, up to 9, up to 10, up to 11, up to 12, up to 13, up to 14, up to 15, up to 16, up to 18, up to 20, up to 24, up to 32, up to 40, up to 50, up to 60, up to 70, up to 80, up to 90, up to 100, at least 2, at least 3, at least 4, at least 5, at least 6, at least 7, at least 8, at least 9, at least 10, at least 11, at least 12, at least 13, at least 14, at least 15, at least 16, at least 18, at least 20, at least 24, at least 32, at least 40, at least 50, at least 60, at least 70, at least 80, at least 90, at least 100, or the like. In one example, the shaft 104 is threaded at one or more segments of the shaft length. In another example, the shaft 104 is threaded along the entirety of the shaft length.

Figure 2A:
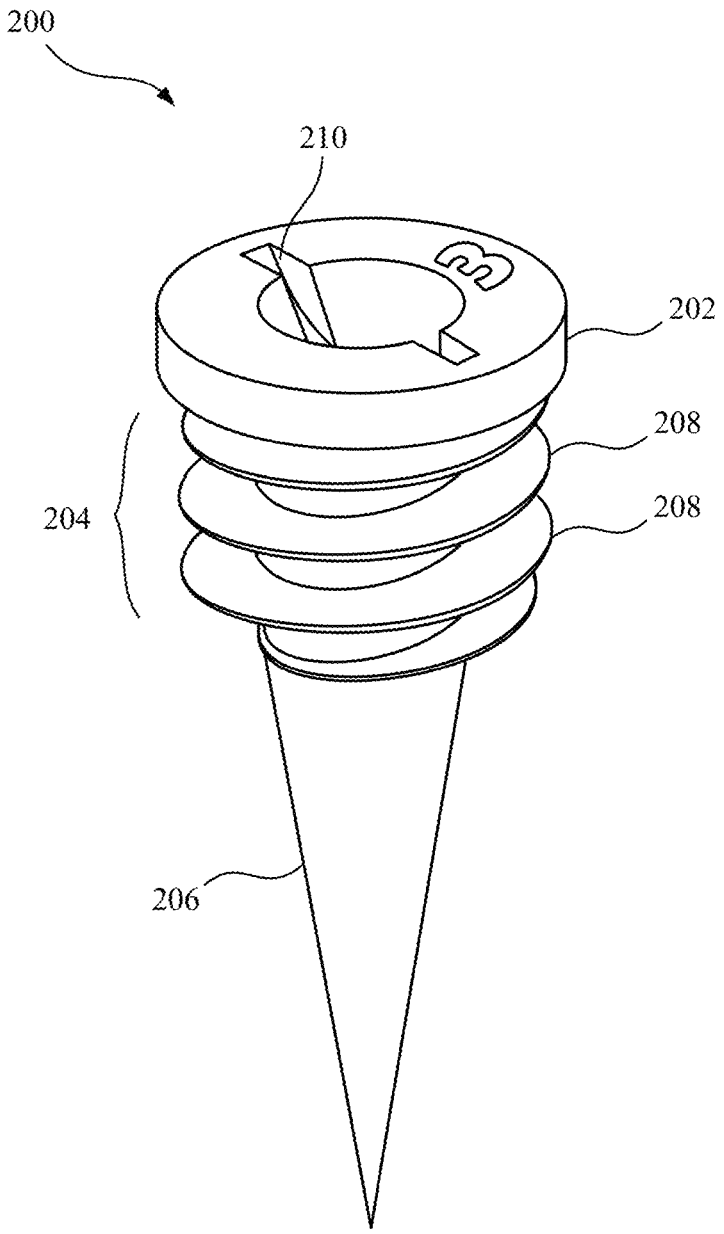
FIGS. 2A-2C illustrate an example anchor.
Figure 2B:
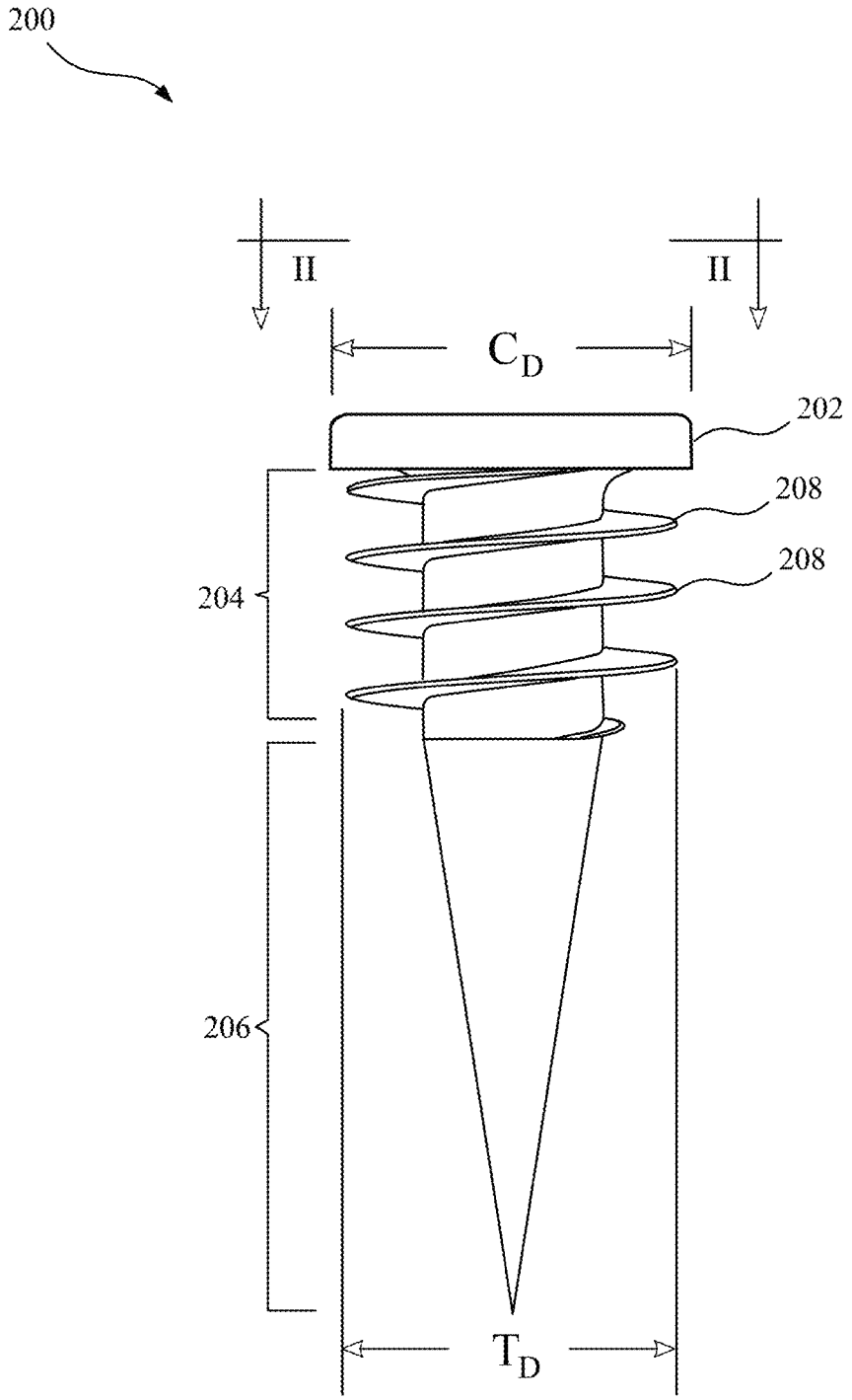
Figure 2C:
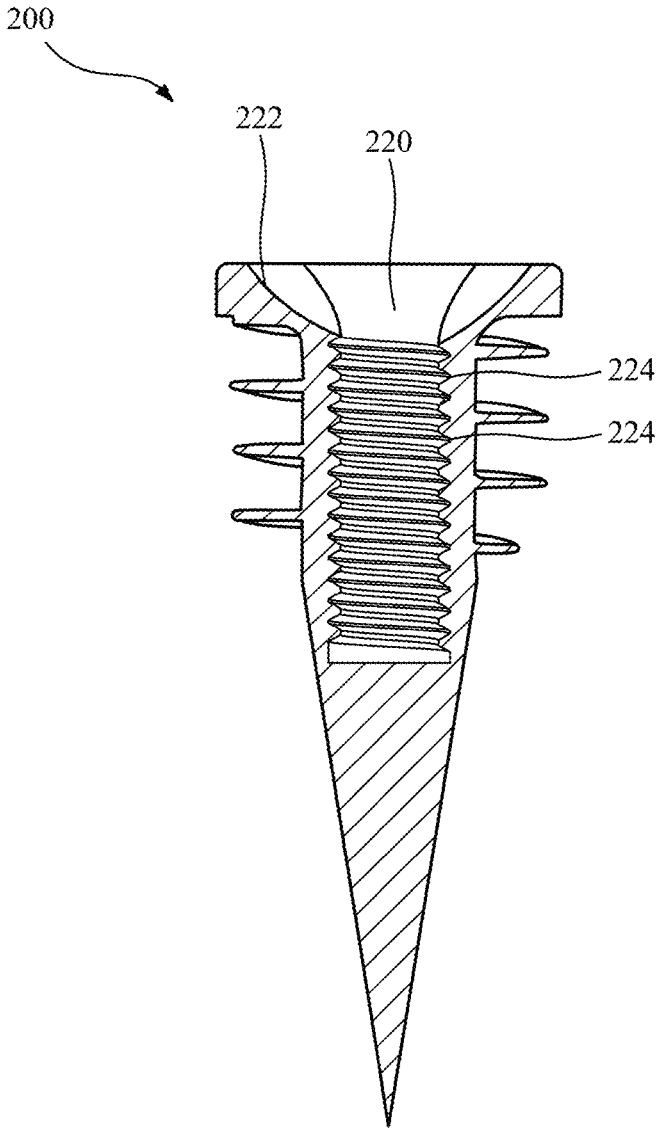

FIG. 2A shows an anchor 200, such as for use in a natural surface. FIG. 2B shows a cross-sectional view of the anchor 200 taken along the line 11-11. The anchor 200 includes a stem 204 (such as the illustrated central stem), a fixed anchor cap or cap 202 at a first end of the stem 204, and a tip 206 at a second end of the stem 204. The anchor 200 also includes a cavity 220 (formed, for example, by one or more inner walls within the anchor 200) sized and shape to accept and engage the shaft 104, the tip 106, or both. The cavity 220 can be fully threaded, partially threaded, or not threaded at all. In one example, the cavity 220 extends from the top surface of the cap 202 distal to the stem 204 into the pointed section, such as the tip 206, thereby forming a hollow core. In another example, the cavity 220 extends from the top surface of the cap 202 distal to the stem 204 into the stem 204 without entering the tip 206.

The cap 202 includes a slot 210 extending from a portion of the cavity 220 on top portion of the cap 202 or a portion of the cavity 220 proximal to the cap 202. The slot 210 can receive a device or object (e.g., screwdriver, coin, finger, fingernail, a spike wrench, a sport wrench, or the like) for securing the anchor 200 into the ground, such as by screwing, pushing, or twisting. The anchor 200 can include multiple slots 210.

An upper surface of the cap 202 can sit flush with the ground, or a bottom surface of the cap 202 can rest on top of the ground. In one example, a portion of an inner wall the cap 202 includes a curved or tapered surface to provide access to a deeper portion of cavity 220, thereby permitting a broken or sheared tee to be removed.

Alternatively, or additionally, to the slot 210, the portion of the cavity 220 at the side of the cap 202 distal to the stem 204 can be larger than largest diameter of the shaft 104 or the tip 106 and can be shaped to receive a wrench, such as an Allen wrench or sports/spike wrench.

The length of the stem 204 can range from 1/64 inch (0.396875 mm) to 3.5 inches (88.9 mm), such as in increments of 1/64 inches (or, 0.396875 mm).

In one example, the stem 204 includes threads 208. The threads 208 can be any appropriate size, including, without limitation, ranging from 1/64 inch (0.396875 mm) to 1 inch (25.4 mm), such as in increments of 1/64 inches (or, 0.396875 mm). The stem 204 can include any appropriate number of threads, whether in total or in threads per inch, including, without limitation, 1, 2, 3, 4, 5, 6, 7, 8, 9, 10, 11, 12, 13, 14, 15, 16, 18, 20, 24, 32, 40, 50, 60, 70, 80, 90, 100, up to 2, up to 3, up to 4, up to 5, up to 6, up to 7, up to 8, up to 9, up to 10, up to 11, up to 12, up to 13, up to 14, up to 15, up to 16, up to 18, up to 20, up to 24, up to 32, up to 40, up to 50, up to 60, up to 70, up to 80, up to 90, up to 100, at least 2, at least 3, at least 4, at least 5, at least 6, at least 7, at least 8, at least 9, at least 10, at least 11, at least 12, at least 13, at least 14, at least 15, at least 16, at least 18, at least 20, at least 24, at least 32, at least 40, at least 50, at least 60, at least 70, at least 80, at least 90, at least 100, or the like. In one example, the stem 204 is threaded at one or more segments of the stem length. In another example, the stem 204 is threaded along the entirety of the stem length.

In one example, the stem 204 is fluted. The flutings provide increased resistance in the ground due to stresses (e.g., shear stress) or forces exerted on the anchor 200 when a golf ball is driven off the tee 100. The flutings can be any appropriate shape including, without limitation, semi-spherical, conical, pyramidal, rectangular, triangular, or the like. Alternatively, the stem 204 can have one or more projections extending outwardly, downwardly, upwardly, or combinations thereof. While fluting creates one or more grooves (i.e., the grooves are carved into an outer surface of the stem 204), the projections extend from the outer surface of the stem 204. In another example, the stem 204 can be fluted and include one or more projections.

In one example, the threads, flutes, or projections have a diameter ($T_D$) greater than a cap diameter $C_D$. In another example, the threads, flutes, or projections have a diameter ($T_D$) less than the cap diameter $C_D$. In yet another example, the threads, flutes, or projections have a diameter ($T_D$) equal to the cap diameter $C_D$.

The tip 206 can be sized (e.g., ranging from 1/64 inch (0.396875 mm) to 3.5 inches (88.9 mm), such as in increments of 1/64 inches (or, 0.396875 mm)) and shaped (e.g., tapered, cylindrical, pointed, conical, pyramidal, triangular, "X", "+", rectangular, the like, or combinations thereof) based on the type of ground into which the anchor 200 is being inserted or the conditions of the ground at the time of insertion. The size and shape can also be selected to increase the ease of insertion of the anchor 200 into the ground. For example, when the soil or ground is rocky, the tip 206 can be shorter to reduce the chance of breaking and sharper (i.e., smaller internal angle) to better penetrate the rocks or between the rocks. As another example, when the soil or ground is loose, the tip 206 can be longer to increase forces exerted on the anchor 200 by the ground (thereby requiring more forces exerted on the anchor 200 during a drive to cause the anchor 200 to move).

In one example, the cap 202, stem 204, and tip 206 are a single piece. In one example, the cap 202 is removably attached to the stem 204, such as by threads, detents, dovetail joint, tongue-and-groove joint, press fit, the like or combinations thereof. Removing the cap 202 from the stem 204 provides access to a deeper portion of the cavity 220, thereby permitting a broken or sheared tee to be removed. In another example, the tip 206 is removably attached to the stem 204, such as by threads, detents, dovetail joint, tongue-and-groove joint, press fit, the like or combinations thereof. Removing the tip 206 from the stem 204 allows for the replacement or switching of stem 204*s*, such as when the tip 206 breaks or to accommodate different ground or soil conditions.

Figure 3:
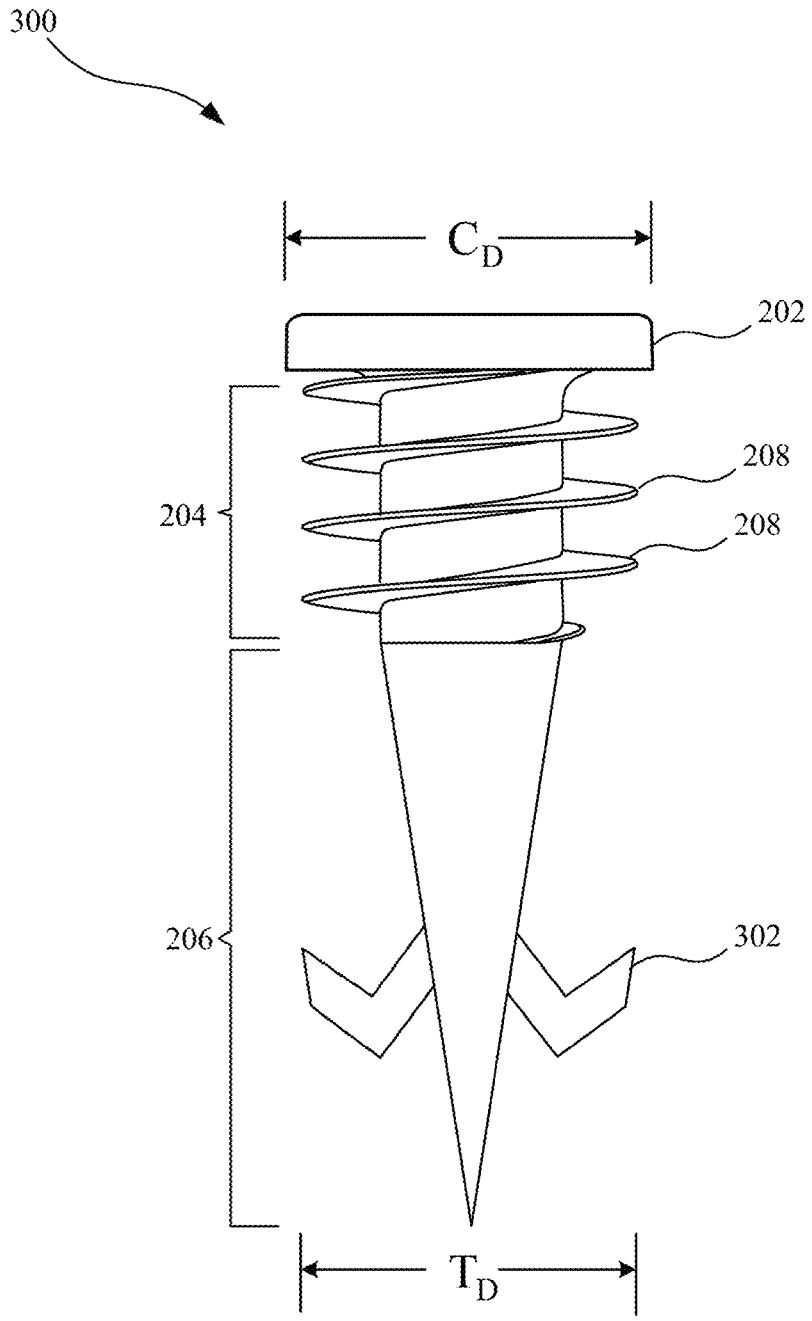
FIG. 3 illustrates an example anchor.

FIG. 3 shows an anchor 300 with barbs 302. The anchor 300 is similar to the anchor 200, except that anchor 300 includes the barbs 302. The barbs 302 can extend outwardly, downwardly, upwardly, or combinations thereof from the tip 206 or the cap 202 to increase grip force. The barbs can also extend outwardly, downwardly, upwardly, or combinations thereof from the shaft 204, such as when the shaft 204 is not threaded.

Figure 4A:
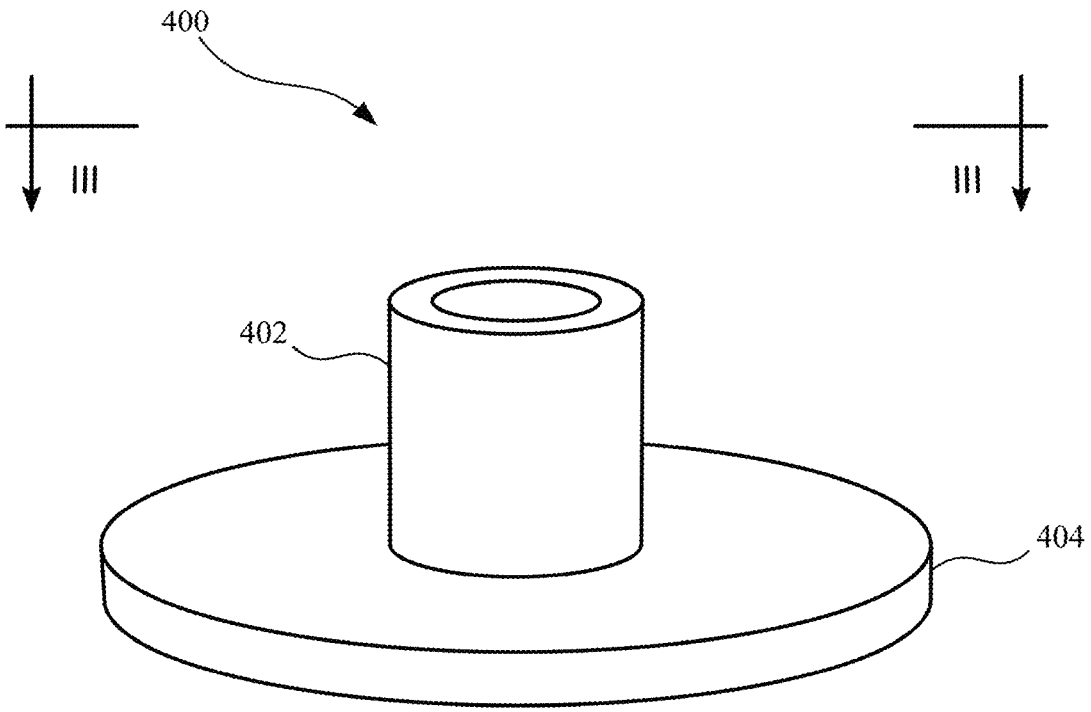
FIGS. 4A-4B illustrate an example anchor.
Figure 4B:
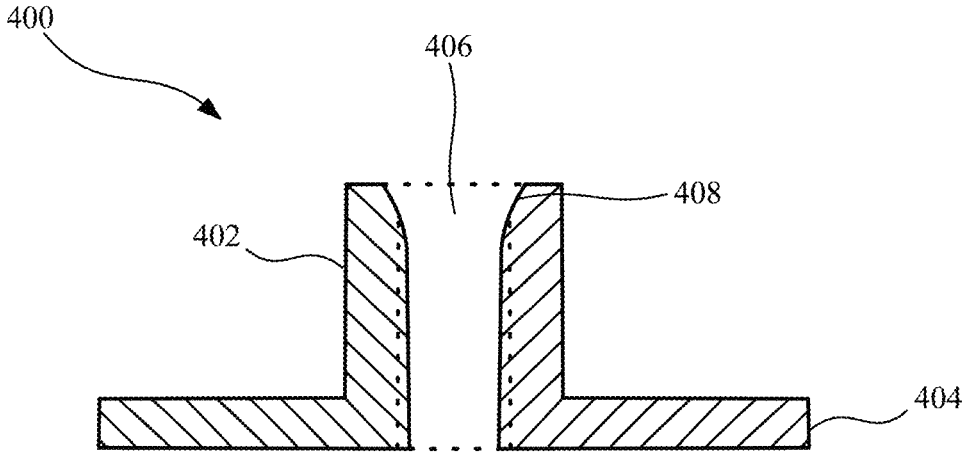

FIG. 4A shows an anchor 400, such as for use on an artificial surface. FIG. 4B shows a cross-sectional view of the anchor 400 taken along the line III-III. The anchor 400 includes a stem 402 and a base 404. The diameter of the stem 402 is sized to fit through a hole in a driving range mat. The diameter of the base 404 is sized to prevent the anchor 400 from being pulled through the hole in the same direction as the stem 402 when inserted into the mat (i.e., the base diameter is larger than the diameter of the hole in the mat). The anchor 400 also includes a cavity 406 (formed, for example, by one or more inner walls within the anchor) sized and shape to accept and engage the shaft 104 of the tee 100. The cavity 406 can be fully threaded, partially threaded, or not threaded at all.

The length of the stem 402 can range from 1/4 inch (6.35 mm) to 3.5 inches (88.9 mm), such as in increments of 1/64 inches (or, 0.396875 mm). In one example, an anchor having a first stem height can be provided. In another example, more than anchor, each having different stem heights, can be provided.

In one example, the stem 402 and the base 404 are a single piece. In another example, the stem 402 or a portion thereof is removably attached to the base 404, such as by threads, detents, dovetail joint, tongue-and-groove joint, press fit, the like or combinations thereof. Removing the stem 402 from the base 404 provides access to a deeper portion of the cavity 406, thereby permitting a broken or sheared tee to be removed.

In one example, a portion of an inner wall of the stem 406 includes a curved or tapered surface 408 at the side of the stem 406 opposite the base 404 to provide access to a deeper portion of the cavity 406, thereby permitting a broken or sheared tee to be removed.

In one example, the base 404 includes one or more barbs extending upwardly, outwardly, downwardly, or combinations thereof to provide more secure grip to the mat, the ground, or a combination thereof.

Figure 5A:
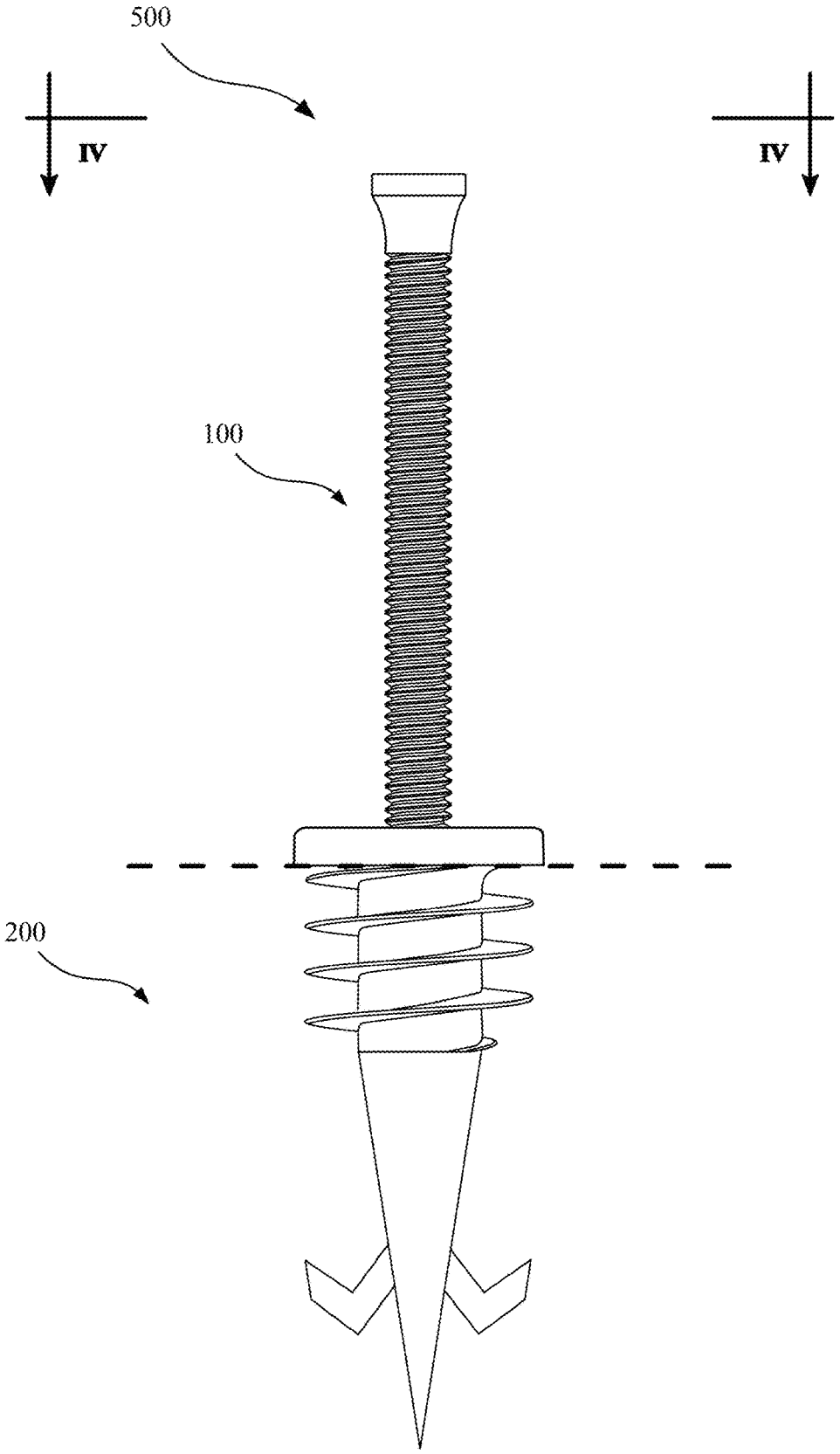
FIGS. 5A-5B illustrate an example assembled golf tee.
Figure 5B:
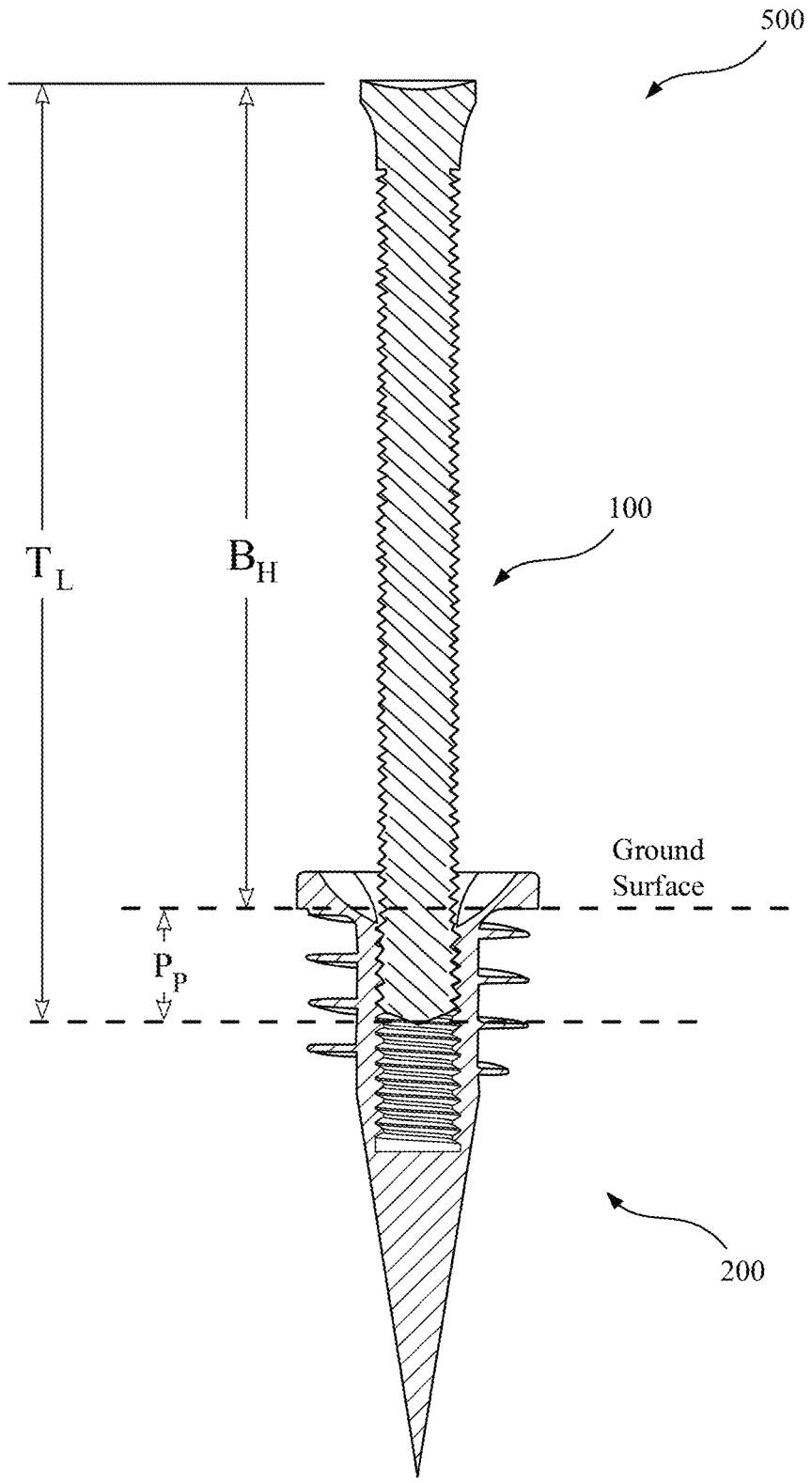

FIG. 5A shows an assembled golf tee system 500. FIG. 5B shows a cross-sectional view of the assembled golf tee system 500 along the line IV-IV. In one example, the anchor 200 is first inserted into the ground (or the mat, where appropriate). The tee 100 is then inserted into the anchor 200. The ball height $B_H$ can be adjusted by rotating the tee 100 clockwise or counter-clockwise. The ball height $B_H$ can be a distance from a bottom of the cap 202 (i.e., where the cap 202 would contact and rest on the ground surface) to a ball-contacting surface of the head of the tee when the tee is inserted into the cavity of the anchor.

In one example, the ball height $B_H$ is 86.12 mm. Therefore, having a 12.7 mm penetrating portion $P_P$ (i.e., portion of the tee 100 that extends from the bottom of the cap 202 to the tip 106 of the tee 100; or, a portion of the tee 100 that is at and below the ground surface when the golf tee system 500 is inserted into the ground) provides a tee length $T_L$ of 98.82 mm. Alternatively, the penetrating portion $P_P$ can be 3.175 mm, 6.35 mm, 9.525 mm, or greater, thereby providing tee lengths $T_L$, with ball heights $B_H$ of 86.12 mm, of 89.295 mm, 92.47 mm, 95.645 mm, or greater. Furthermore, the ball height $B_H$ is not intended to be so limited. The ball height $B_H$ can be at least 3.175 mm. The ball height $B_H$ can also be adjusted based on golfer preference.

In other words, the tee length $T_L$ is equal to the sum of ball height $B_H$ and the penetrating portion $P_P$ of the tee 100.

In one example, the tee 100 is already inserted and adjusted within the anchor 200 before insertion of the anchor 200 into the ground (or mat, where appropriate). For example, a golfer can adjust the ball height $B_H$ at the first practice range. Then, the golfer may remove the fully-assembled golf tee system 500 from the ground and then insert the fully-assembled golf tee system 500 at a different location of the first practice range or at a second practice range. This provides a consistent ball height $B_H$, such from location to location or range to range, with no additional measuring required.

In other words, the ball height $B_H$ can remain consistent from hole to hole, range to range, and course to course. The tee 100 can remain fixed relative to the anchor 200 by the threads, a force fit, a locking mechanism, such as a stop, lock, or plug.

Additionally, though the tee 100 is discussed as having threads, the tee 100 need not be so limited. For example, the tee 100 can have detents, clips, bumps, indentations, or the like. The tee 100 can be height-adjusted by a press fit or by engaging with complementary holes, detents, or clips on an inner wall or surface of the anchor. Therefore, a non-threaded tee can be pushed or pulled into or out of the anchor to adjust the ball height $B_H$—though the pushing or pulling may need to overcome one or more forces (such as those due to a press fit, clips, detents, etc.).

The tee and the anchor can each be composed of a variety of different materials including, but not limited to, a ceramic; a metal; organic or inorganic materials; wood; one or more plastics; one or more rubbers, including silicone; the like; or combinations thereof.

A kit including one or more tees, one or more anchors, one or more anchor tips, the like, or combinations or multiples thereof. In one example, a kit can include one anchor and multiples tips, such that no two tips have all of the same characteristics. For example, a first tip can be longer and narrow than a second tip. Or, for example, a first tip can be made of a softer or more pliable material than a second tip. The characteristics can include density, hardness, length, shape, taper, barb, the like, or combinations or multiples thereof.

In another example, a kit can include one anchor and multiple tips, such that the tips are identical.

Figure 6A:
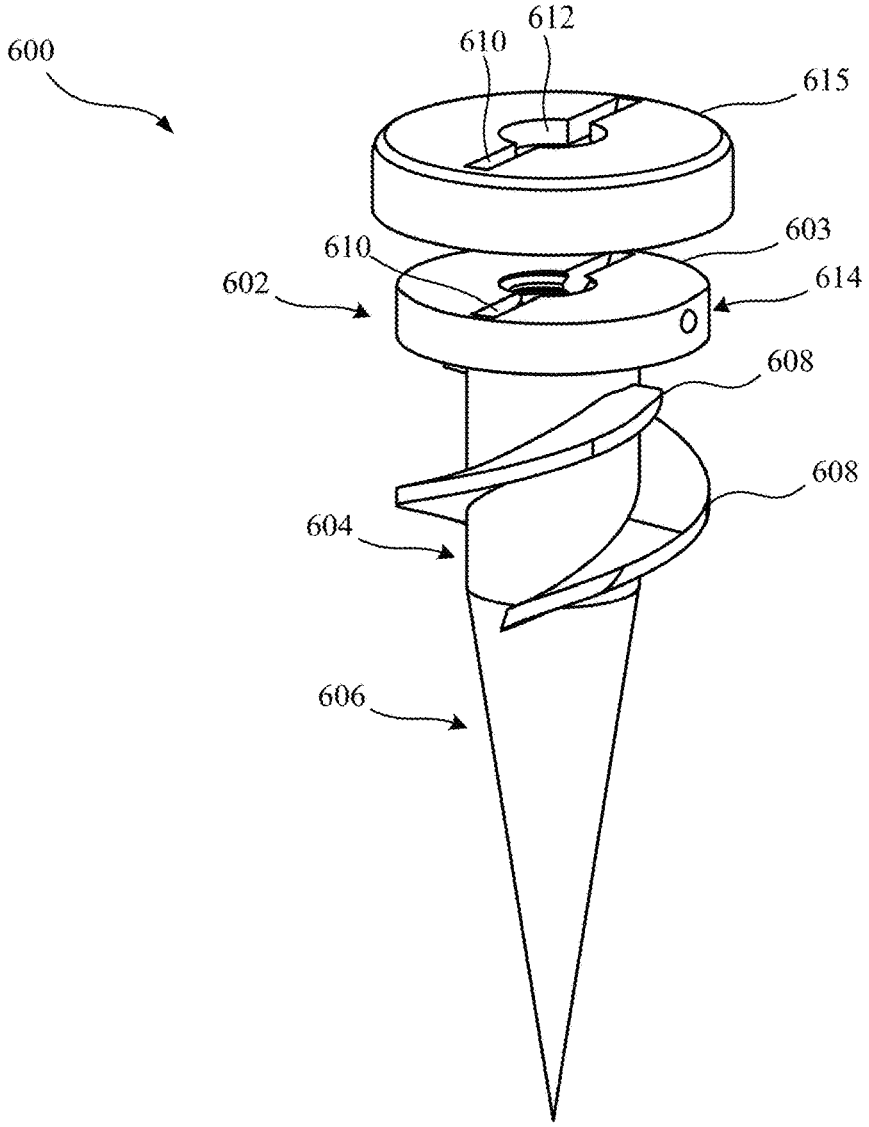
FIG. 6A-B illustrate an example anchor.
Figure 6B:
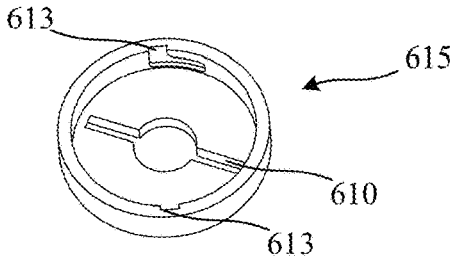

FIG. 6A shows a golf tee system 600, with the removable cap 615, shown slightly removed from the fixed cap of the anchor portion 600. The golf tee system has a central shaft 604, upon which threads 608 are disposed. The lower section has a spike 606. The threads are configured to bite into and pull the tee system 600 into the ground. FIG. 6B shows the underside of the removable cap 615. As depicted, the anchor portion has a locating pin 614 on the side of the cap 603. The pin 614 is designed to locate into a corresponding slot 613 in the removable cap 615. The corresponding slot 615 is shown in FIB 6B. More than one pin 614 may be located on the anchor cap 603. Further, the position of the pin 614 may change. In some embodiments, for example, the pin 614 may be located on the top surface, as opposed to the side, and function in the same manner. Further, there may be more slots 613 than pins 614. In an embodiment with additional slots 613, this would allow a user to lock the removable cap 615 into place from more than one starting position. For example, as depicted, there are two slots 613 positioned opposite one other on the removable cap 615. The shown slots may correspond to a single pin 614, or, optionally, two pins 614.

Occasionally, a tee 100 may sheer off or separate. Often this occurs just below the surface of the removable cap 615. In a preferred embodiment, the removable cap 615 is not threaded, and has an opening 612 wide enough such that a tee 100 can pass through. When a tee 100 sheers, the removable cap 615 can be removed. This reveals a portion of the sheered tee, allowing the user to grasp the sheered portion and remove it from the anchor system 600. In various embodiments, the height of the removable cap 615 may be greater than depicted, and the removable cap 615 may be configured to extend into the portion of the anchor 600 that continues into the ground. In such an embodiment, the removable cap portion is still removable, to allow for the exposure of a sheered tee portion. For example, in an alternative embodiment such as the one described, the removable cap may extend to alternative point at the shaft 604. The cap portion may connect to the anchor body in a similar keyed manner, or the two components may screw together.

According to the golf tee system 600, both the removable cap 615 and the top of the anchor cap 603 may each have a slot 610 to aid installation of the tee into the surface. The slot 610 allows for a specific tool, such as those described herein or something more generic, such as a coin, to be inserted into the slot 610 to aid the spinning of the system 600 into the ground. The slot 610 can receive a device or object (e.g., screwdriver, coin, finger, fingernail, a spike wrench, a sport wrench, or the like) for securing the anchor 600 into the ground, such as by screwing, pushing, or twisting. The anchor 600 can include multiple slots 610. In additional examples, only the removable cap 615 or only the anchor top 603 has a slot 610 in its upper surface.

Figure 7A:
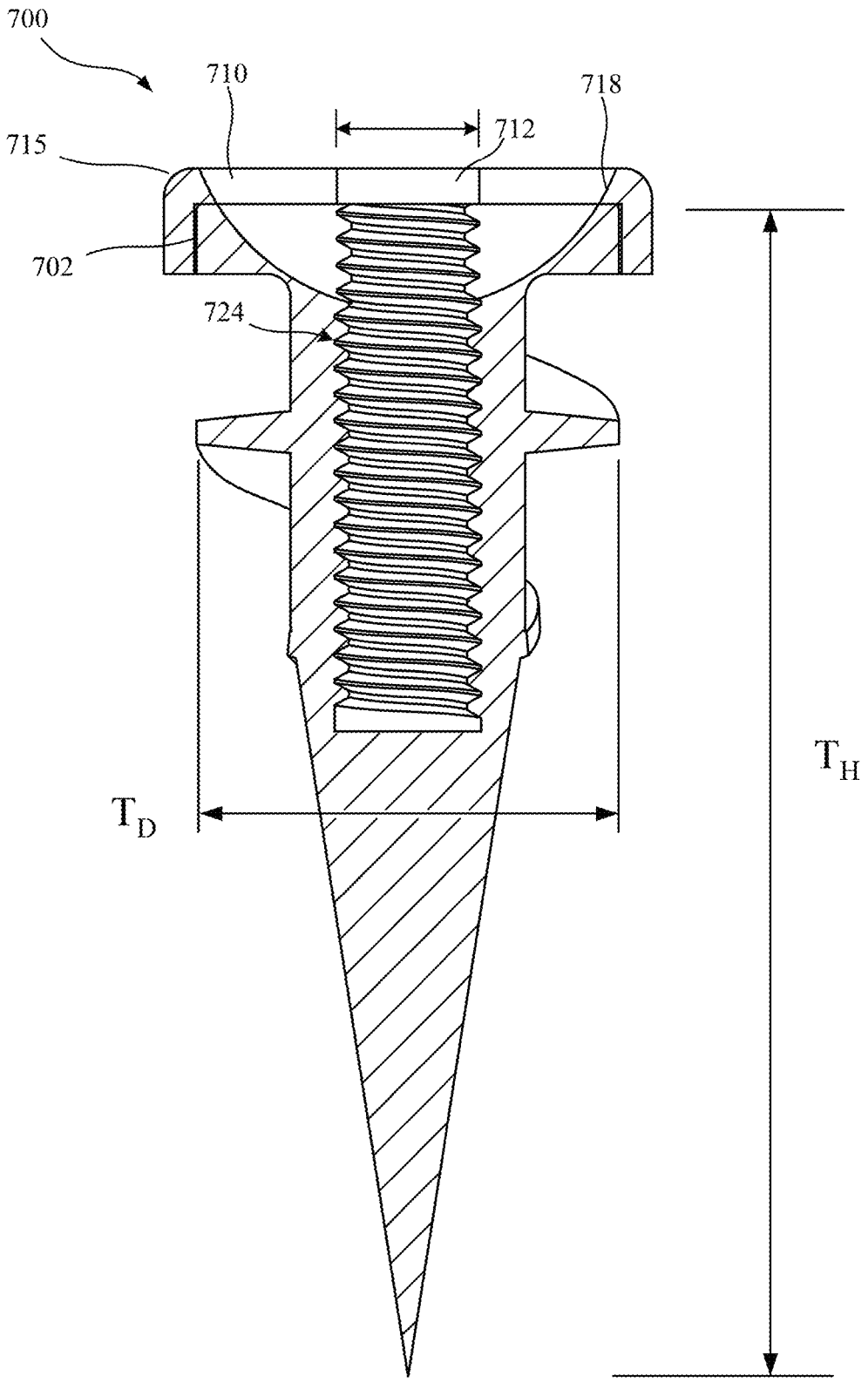
FIG. 7A-B illustrate an example anchor.
Figure 7B:
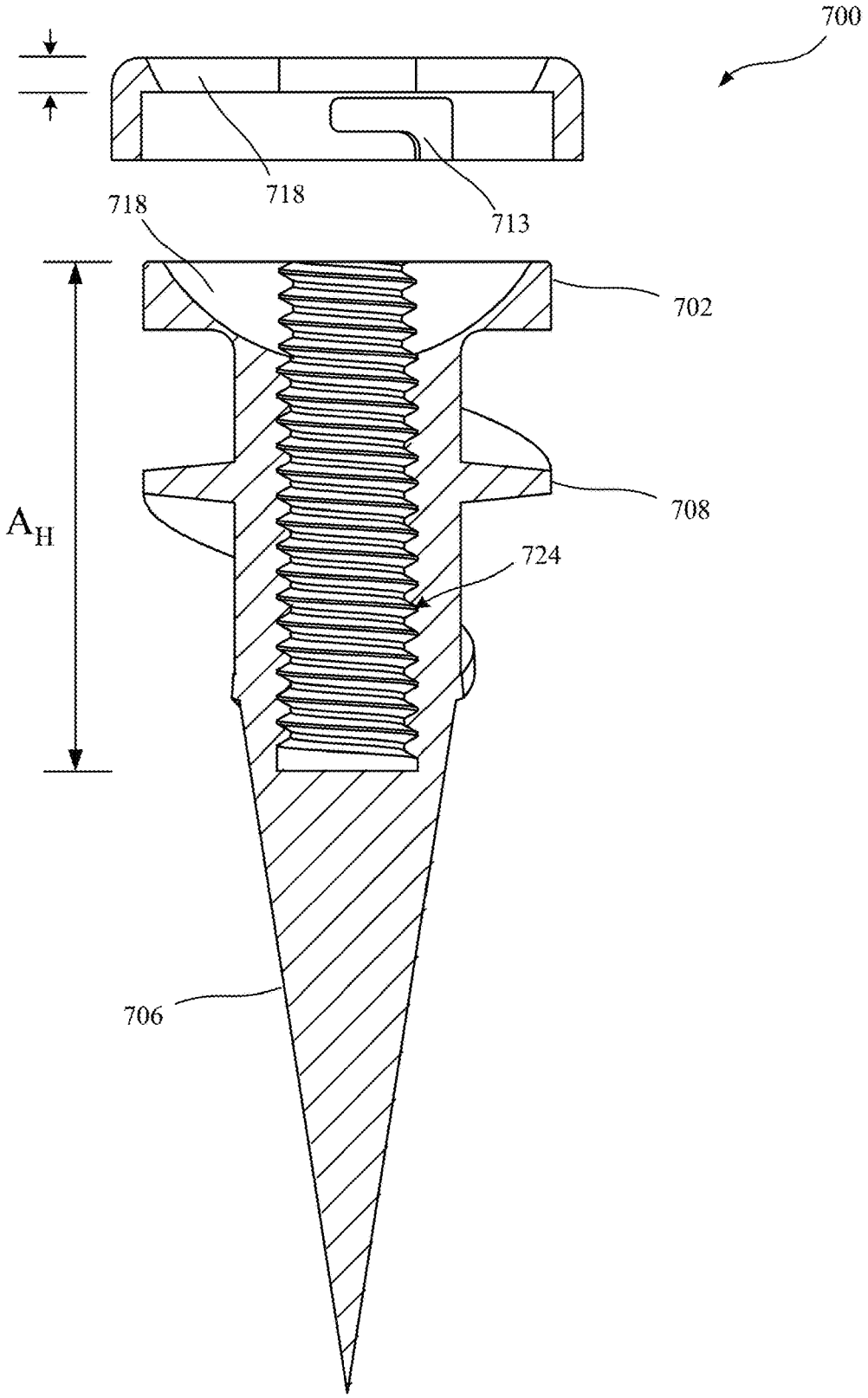

FIGS. 7A and 7B show a cut away of the tee system 700. In one example, the anchor 700 is first inserted into the ground (or the mat, where appropriate), with removable cap 715 installed. The tee 100 is then inserted through the removable cap 715 and into the anchor 700. The ball height and tee height can be adjusted in the same fashion as systems described above. According to an embodiment of the system 700, the ball height $B_H$ can be a distance from a bottom of the cap 715 (i.e., where the cap 715 would contact and rest on the ground surface) to a ball-contacting surface of the head of the tee when the tee is inserted into the cavity of the anchor. In such an embodiment, the removable cap 715 contacts the ground surface at the same point as the cap 702. In this manner, the cap does not affect the ball height $B_H$. Preferably, $B_H$ should include a range from the USGA limit, to just above the removable cap surface.

As shown, the removable cap 715 fits snuggle over the top of the anchor cap 702. As described above, the removable cap can engage a pin in the anchor cap 702. For example, the depicted slot 713 located in the underside of the removable cap715, shown in FIG. 7B, may accept the pin, and then be locked into place by twisting the removable cap 715 relative to the anchor cap 702. In various embodiments the removable cap may have a thickness, depicted by opposing arrows in FIG. 7B, of 0.08 inches. In additional embodiments the removable cap may have a thickness of 0.03 to 0.25 inches. The total inside width of the removable cap may be 1.04 inches, but may also be between 0.0.50 inches and 1.95 inches. In terms of percentage, depending on the embodiment, the removable cap 715 may increase the total width of the system 700 by between 5-20%. In alternative embodiments, the cap 702 may not include a flanged section as depicted. In such an embodiment, the removable cap 715 may include the flanged section and may be thicker, and a larger percentage of the total width as a result, for example, up to or more than 100%.

The removable cap 715 preferably has a centrally located hole 712, through which a tee 100 may pass. When in use, should a tee 100 sheer off at or near the top surface of the removable cap 715, the user may simply disengage the removable cap from the cap 702. When the removable cap 715 is removed, the sheered portion of the tee is exposed and can be removed. In a preferred embodiment, this removal process is aided by the threaded portion 724 of the anchor 700 not extending into the removable cap 715. This allows the removable cap 715 to be easily removed from the anchor cap 702 without catching on the tee. In additional examples, the threaded portion 724 may not extend to the cap 702, and instead may begin at the deepest portion of radius 718. The removable cap 715 also preferably has a radius bevel along its upper edge. This aids in comfort. In additional examples, the removable cap 715 may have dimpling, stippling, or a texturized side surface (the portion perpendicular to the ground), which may aid a user's grip. The removable cap also may include a fastener in its upper surface. For example, in a preferred embodiment, the upper surface includes a slot with a width of about 0.075 inches and a length of about 0.80 inches. The slot may also be cut at a radius 718, such that the portion of the slot closest to the outer edge of the removable cap 718 is shallowest, and the portion closest to the central hole 712 is deepest. Such an arrangement is beneficial for accepting objects such as coins, or the specialty tools described herein. In other examples, the slot 710 may be a constant depth. In additional examples, there may be more than one slot, for example, two slots may be placed in an X or plus (+) pattern.

In one example, the ball height $B_H$ is 86.12 mm. Therefore, having a 12.7 mm penetrating portion $P_P$ (i.e., portion of the tee 100 that extends from the bottom of the cap 202 to the tip 106 of the tee 100; or, a portion of the tee 100 that is at and below the ground surface when the golf tee system 500 is inserted into the ground) provides a tee length $T_L$ of 98.82 mm. Alternatively, the penetrating portion $P_P$ can be 3.175 mm, 6.35 mm, 9.525 mm, or greater, thereby providing tee lengths $T_L$, with ball heights $B_H$ of 86.12 mm, of 89.295 mm, 92.47 mm, 95.645 mm, or greater. Furthermore, the ball height $B_H$ is not intended to be so limited. The ball height $B_H$ can be at least 3.175 mm. The ball height $B_H$ can also be adjusted based on golfer preference. The total height of the system 700 without the cap may be 2.5 inches. In other embodiments, the total height $T_H$ may be between 1.5 and 4 inches. The height $T_H$ may be selected, for example, based on surface conditions. The diameter $T_D$ at the exterior threads 708 may be, for example 0.9 inches. In alternative embodiments, the diameter may be 0.4 inches to 2 inches, based on surface conditions. For example, more aggressive threads 708 may be used in soft conditions to prevent unwanted ejection of the system 700 when struck. In firmer condition, small less aggressive, or less in number, threads 708 may be used. The Anchor portion height, $A_H$ is also depicted, as the length of the body prior to the sharpening point. This height may preferably be about 1.13 inches, but may vary depending on the embodiment. For example, some embodiments may have considerably more threads 708, and therefore a much smaller point 706. In this situation, the $A_H$ would be much larger than depicted. The converse is also true, in some instances less threads 708 may be used, and the $A_H$ may shrink, for example, from 0.25" to 2".

Figure 14:
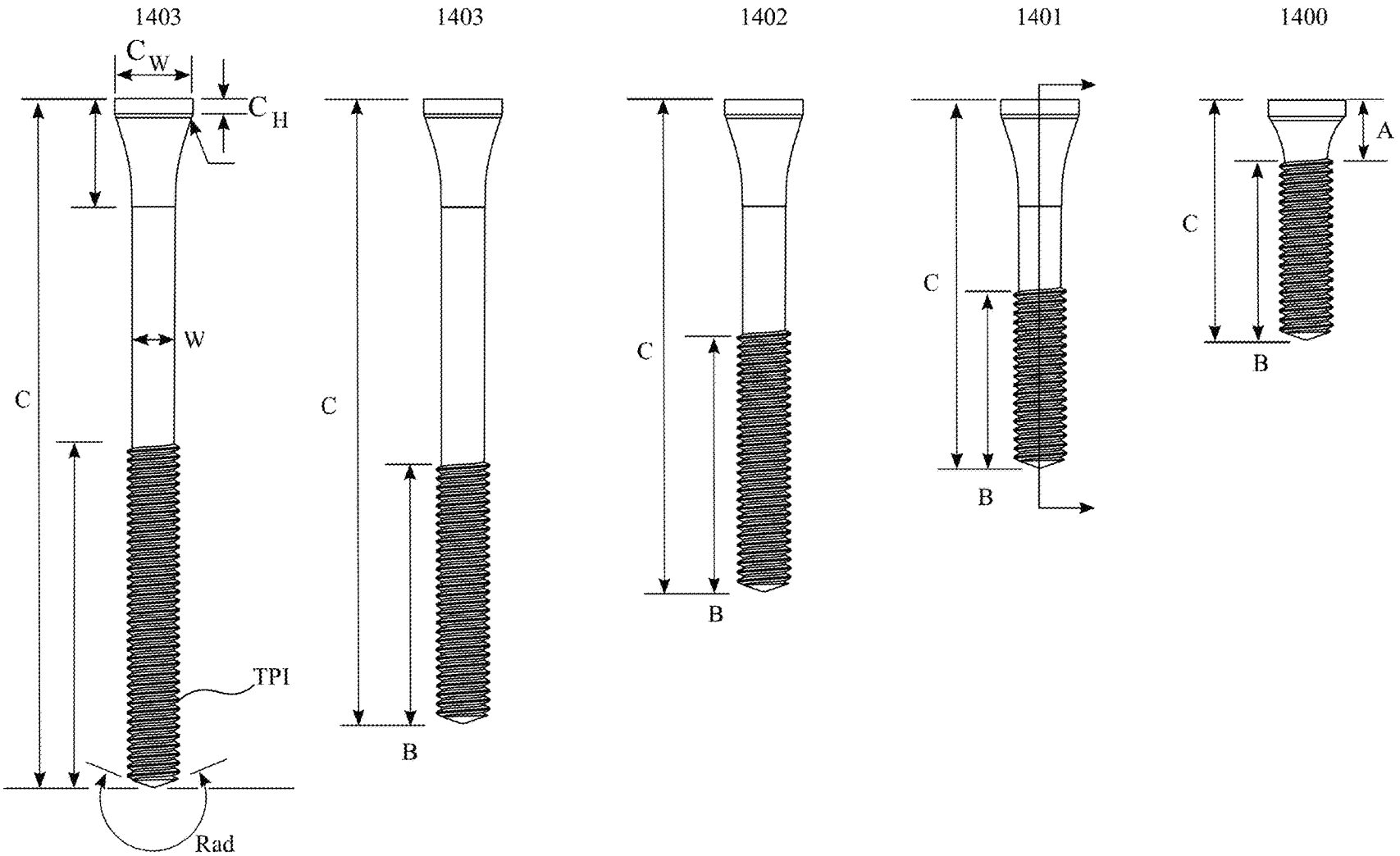
FIG. 14 illustrates an example tee.

In preferred embodiments, the tee will only have threads along a portion of its length, as depicted in FIG. 14. Additionally, though the tee 100 is discussed as having threads, the tee 100 need not be so limited. For example, the tee 100 can have detents, clips, bumps, indentations, or the like. The tee 100 can be height-adjusted by a press fit or by engaging with complementary holes, detents, or clips on an inner wall or surface of the anchor. Therefore, a non-threaded tee can be pushed or pulled into or out of the anchor to adjust the ball height $B_H$—though the pushing or pulling may need to overcome one or more forces (such as those due to a press fit, clips, detents, etc.).

Figure 8:
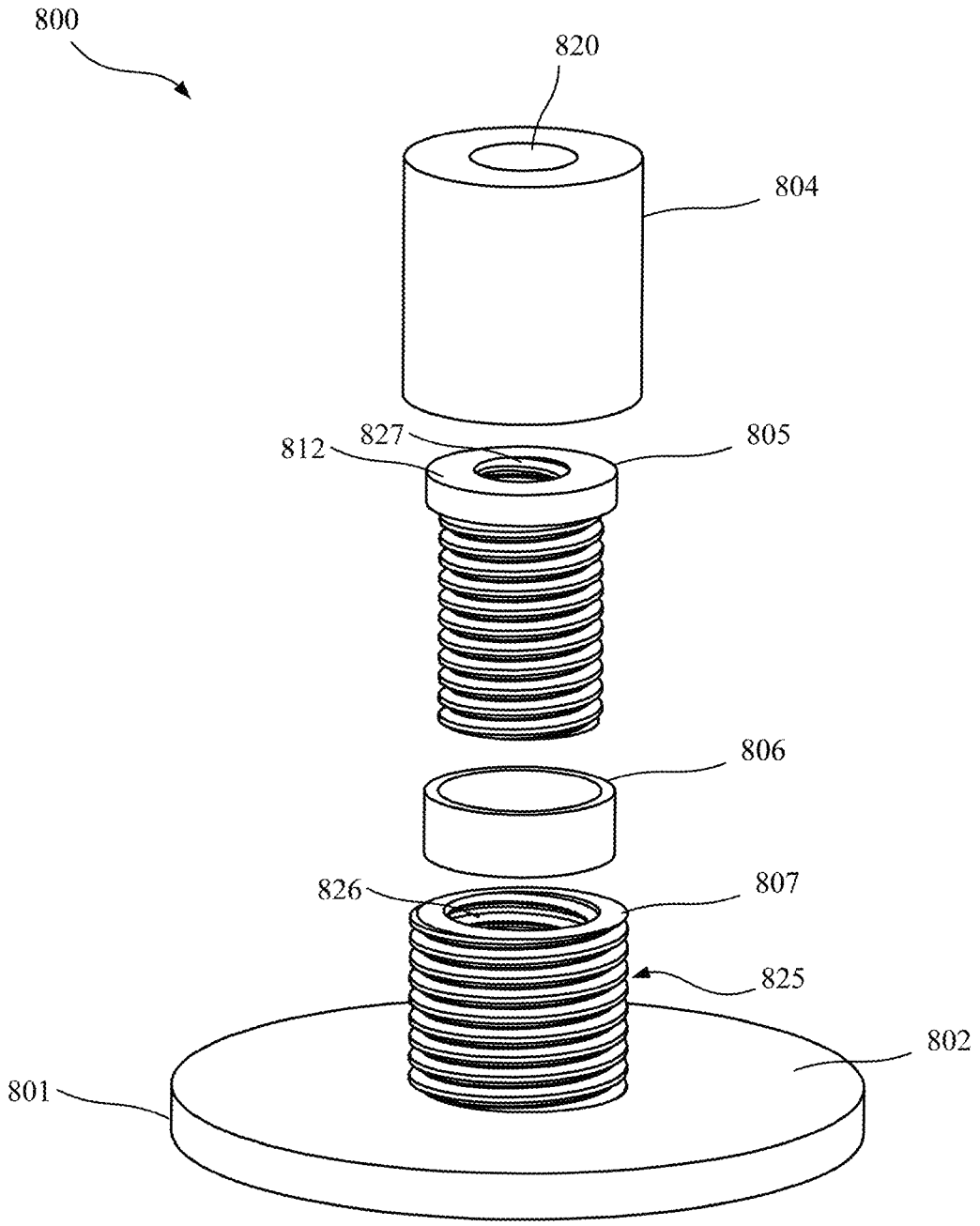
FIG. 8 illustrates an exploded view of an example anchor.

FIG. 8 shows an exploded view of the components of a tee system 800. In a preferred embodiment, the tee system 800 is used with a standard artificial golf mat. In such an embodiment, the flanged portion 802 of the base 801 is located underneath the artificial golf mat, holding the system 800 in place. As shown, the system 800 is comprised of multiple components. The base 802 includes the flanged portion 801, and a stem portion 807. The stem portion includes external 825 and internal threading 826. Another component, the tee mount stem 805, threads into the inner threading 826 of the base stem 807. The tee mount stem 805 includes internal threading 827. The internal threading is configured to accept the shaft (not shown) of the tee portion, through opening 820. The tee mount stem 805 also includes a flanged upper surface 812. Another component of the tee system 800 is the cap 804. The cap is placed over the top of the tee mount stem 805. The inside of the cap 804 includes threads to accept the external threaded portion 825 of the base 801. Another component of the system 800 is an optional removable spacer 806. Any number of spacers 806 may be included. In a preferred embodiment, the system 800 is shipped with two spacers 806 included. The spacer 806 rests between the upper portion of the base portion or stem, and the underside of the flanged upper surface 812 of the tee mount stem 805. When installed, the spacers 806 raise the effective height of the tee mount stem 805 relative to the base 801.

Figure 9:
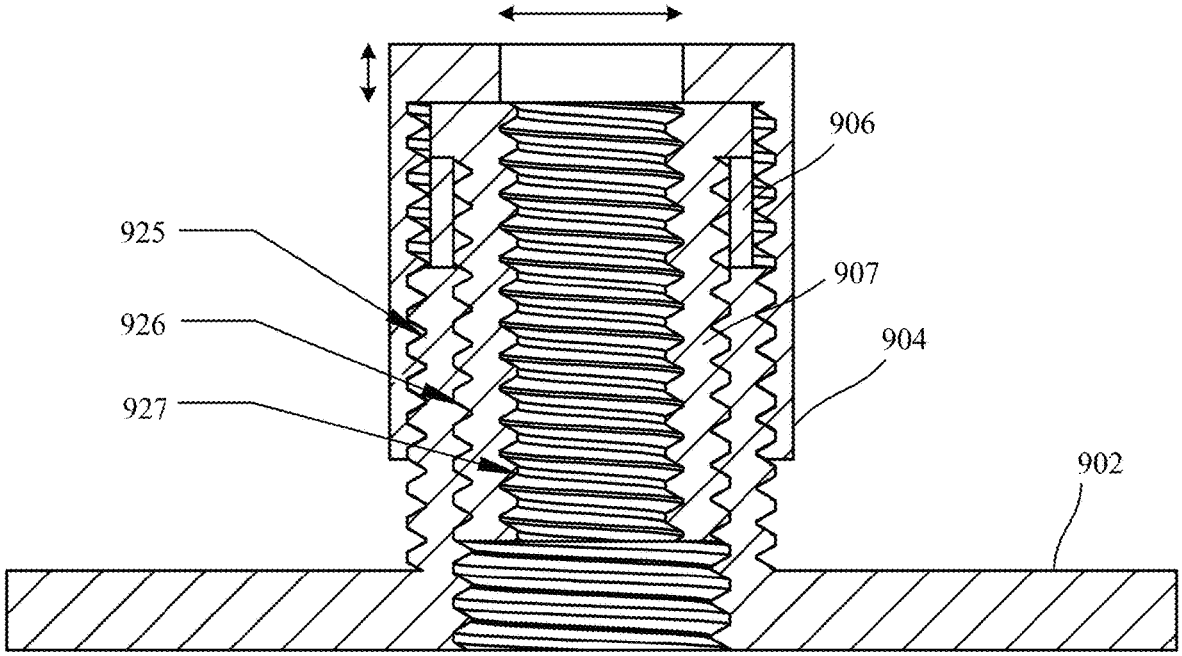
FIG. 9 illustrates a cut away view of an example anchor.

FIG. 9 shows a cut away of a tee system 900. In the shown configuration, the cap 904 is installed, and lowered onto the tee stem 907. The tee stem 907 has been elevated by a single spacer 906. In such a configuration, the cap 904 is raised from the base, accounting for the spacer 906. Three separate threaded portions are shown (904, 906, 907). The first threaded portion is between the cap 904 and the exterior side of the base stem 907. The second threaded portion is between the tee stem 905, and the interior of the base stem. The third is between the tee (not shown) and the interior of the tee stem 905. Additionally, though the tee is discussed as having threads, and corresponding threads at the interior of the tee stem 905, the tee 100 and tee stem 905 need not be so limited. For example, the tee 100 and tee stem 905 can have detents, clips, bumps, indentations, or the like. The tee 100 can be height-adjusted by a press fit or by engaging with complementary holes, detents, or clips on an inner wall or surface of the tee stem 905. Therefore, a non-threaded tee can be pushed or pulled into or out of the tee stem to adjust the ball height BH-though the pushing or pulling may need to overcome one or more forces (such as those due to a press fit, clips, detents, etc.).

The cap 804 of system 800 preferably has a hole at its center. The hole facilitates insertion of the tee 100 into the tee stem 805. The hole 820 may be of various sizes, but is preferably at least large enough such that the tee may pass through. In some embodiments it may be beneficial where the hole 820 in the cap 804 is as small as practical, in order to prevent debris from entering the system 800. When in use, should a tee sheer off at or near the top surface of the cap, the user may simply disengage the cap 804 from the base stem 807. When the cap 804 is removed, the sheered portion of the tee is exposed and can be removed. In a preferred embodiment, this removal process is aided by the threaded portion of the tee stem 807 not extending into the removable cap 804. Said another way, the tee is not threaded into the cap 804.

Figure 10:
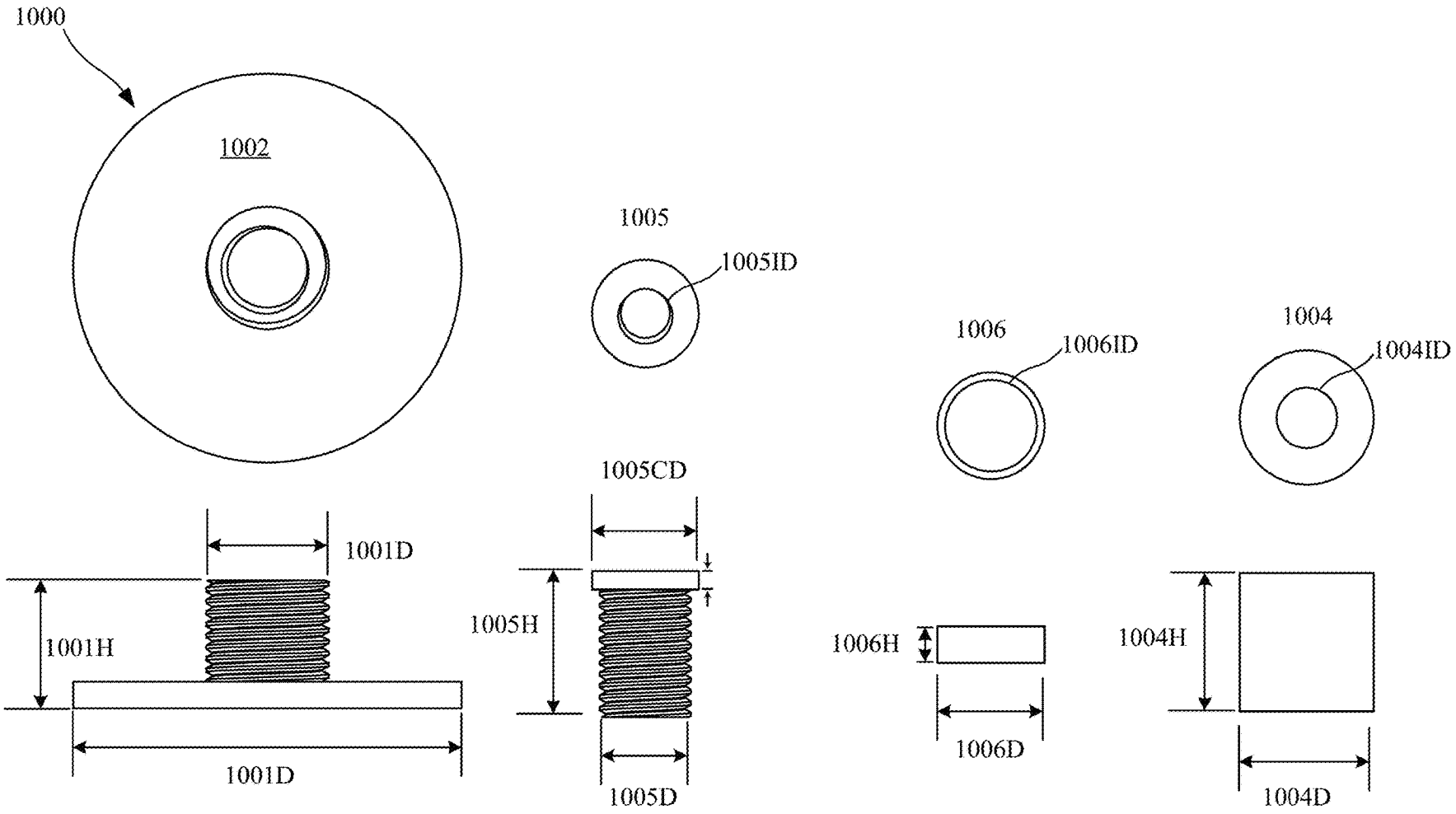
FIG. 10 illustrates an exploded component view of an example anchor.

FIG. 10 shows the components of a tee system 1000. In one example of the system 1000, the base 1001 has a base flange 1002 with a diameter 1001D of about two inches. The diameter 1001D may change depending on the embodiment. Preferably, the base flange 1002 has a diameter that is at least 0.5 inches in diameter. In an additional embodiment the base flange has a diameter that is at least 0.75 inches in diameter. In an additional embodiment the base flange has a diameter that is at least 1 inch in diameter. In an additional embodiment the base flange has a diameter that is at least 1.25 inches in diameter. In an additional embodiment the base flange has a diameter that is at least 1.5 inches in diameter. In an additional embodiment the base flange has a diameter that is at least 1.75 inches in diameter. In an additional embodiment the base flange has a diameter that is at least 2.25 inches in diameter. In an additional embodiment the base flange has a diameter that is at least 2.5 inches in diameter. In an embodiment of the invention, the base flange has a height of 0.137 inches. In additional examples, the base flange has a height between 0.100 inches and 0.250 inches. In an embodiment of the invention, the base stem 807 has a height 1001H from the ground surface, of 0.656 inches. In additional examples, the base stem has a height, from the ground surface, of 0.250 inches to 1.0 inches. In an embodiment of the invention, the base stem has a diameter of about 0.630 inches. In additional examples of the invention, the base stem can have a diameter 1001D of 0.33 to 1 inch. Preferably, the base stem is configured to fit into the hole in a standard artificial golfing mat.

System 1000 also includes a tee stem 1005. In an embodiment of the invention, the tee stem 1005 has a height 1005H of 0.75 inches. In additional examples of the invention, the tee stem can have a height of 0.25 to 1.5 inches. In an embodiment of the invention, the tee stem has a width 1005D, at the threaded portion, of 0.47 inches, corresponding to M12×1.5 threads. In additional examples of the invention, the tee stem can have a width, at the threaded portion, of 0.33 to 1 inches. In an embodiment of the invention, the tee stem includes an upper flanged portion. The upper flanged portion is preferably larger in diameter than the threaded portion of the tee stem. For example, the flanged portion can have a diameter 1005CD of 0.55 inches. In additional examples of the invention, the upper flanged portion can have a diameter between 0.34 and 1.01 inches. The height of the upper flanged portion is preferably 0.094 inches. In additional examples of the invention, the height of the upper flanged portion of the tee stem can be between 0.065 and 0.250 inches.

System 1000 also optionally includes a spacer 1006. In an embodiment of the invention, the spacer 1006 has an outside diameter 1006OD of 0.550 inches and an inside diameter 1006ID of 0.472 inches. The outside diameter and inside diameter preferably correspond with the diameter of the threaded portion of the tee stem, and the upper flange of the tee portion. Preferably, the spacer fits over the threaded portion of the tee stem, but cannot fit over the upper flanged portion of the tee stem. In an embodiment of the invention, the optional spacer 1006 has a height 1006H of 0.188 inches. In additional examples of the present invention, the spacer 1006 can have a height of 0.100 to 0.500 inches.

The system 1000 also includes a cap 1004. In an embodiment of the invention, the cap 1004 has a height 1004H of 0.71 inches. In additional examples of the present invention, the cap can have a height of 0.30 to 1.25 inches. Preferably the cap 804 is of sufficient height such that, with one or more optional spacers 806 installed, the lower edge of the cap 804 can engage the threads 825 on the outer portion of the base stem 807. In an embodiment of the invention, the cap 1004 has a diameter 1004D of 0.69 inches. Preferably, the cap is of a sufficient diameter such that it can engage with the base stem. In one embodiment, the internal walls 826 of the cap 804 have M16×1.5 threads. Other thread size and pitch may be used. In an embodiment of the invention, the cap has a central hole with a diameter 1004ID of 0.31 inches. Preferably, the hole is large enough to allow the tee to pass through.

Figure 11A:
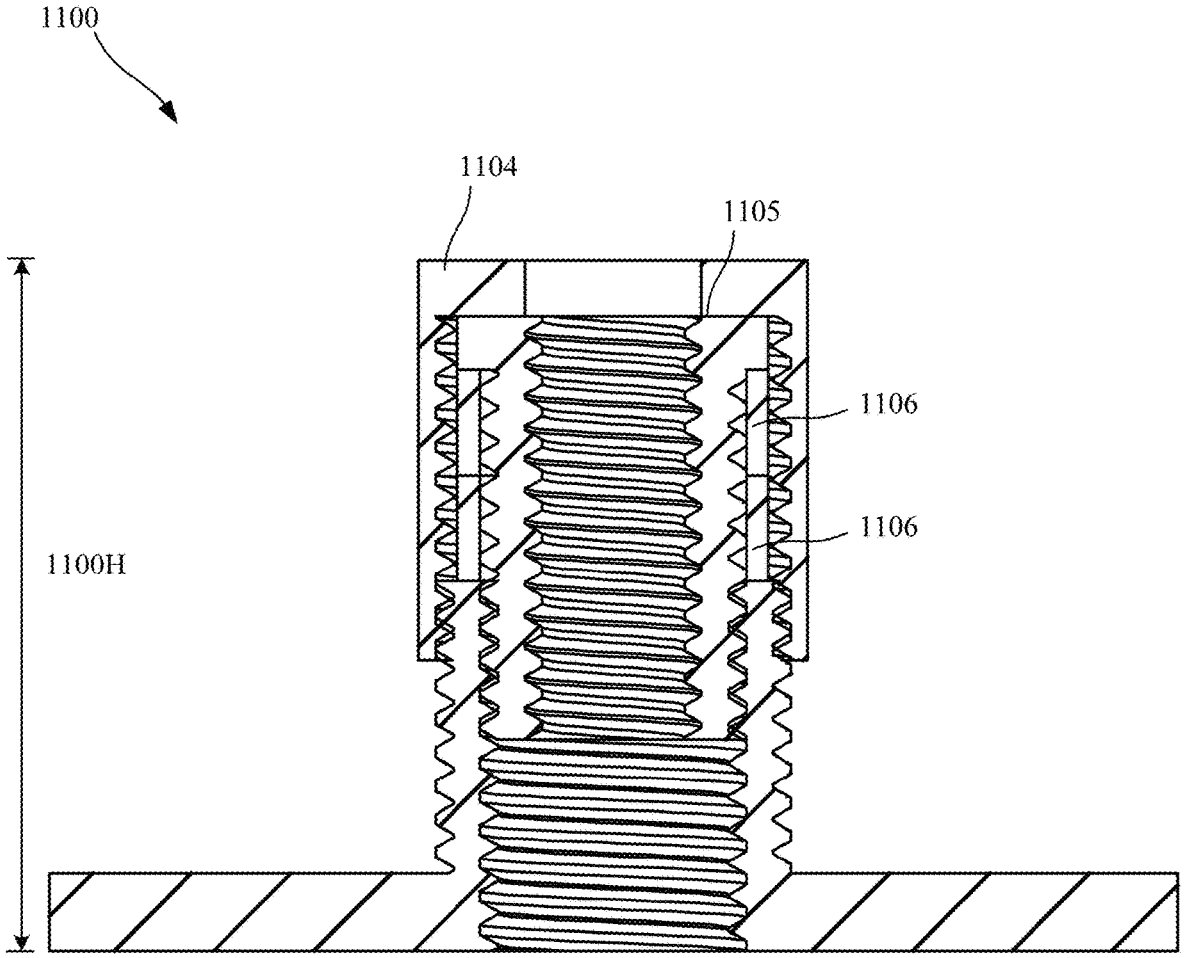
FIG. 11A-C illustrate an example of an anchor.
Figure 11B:
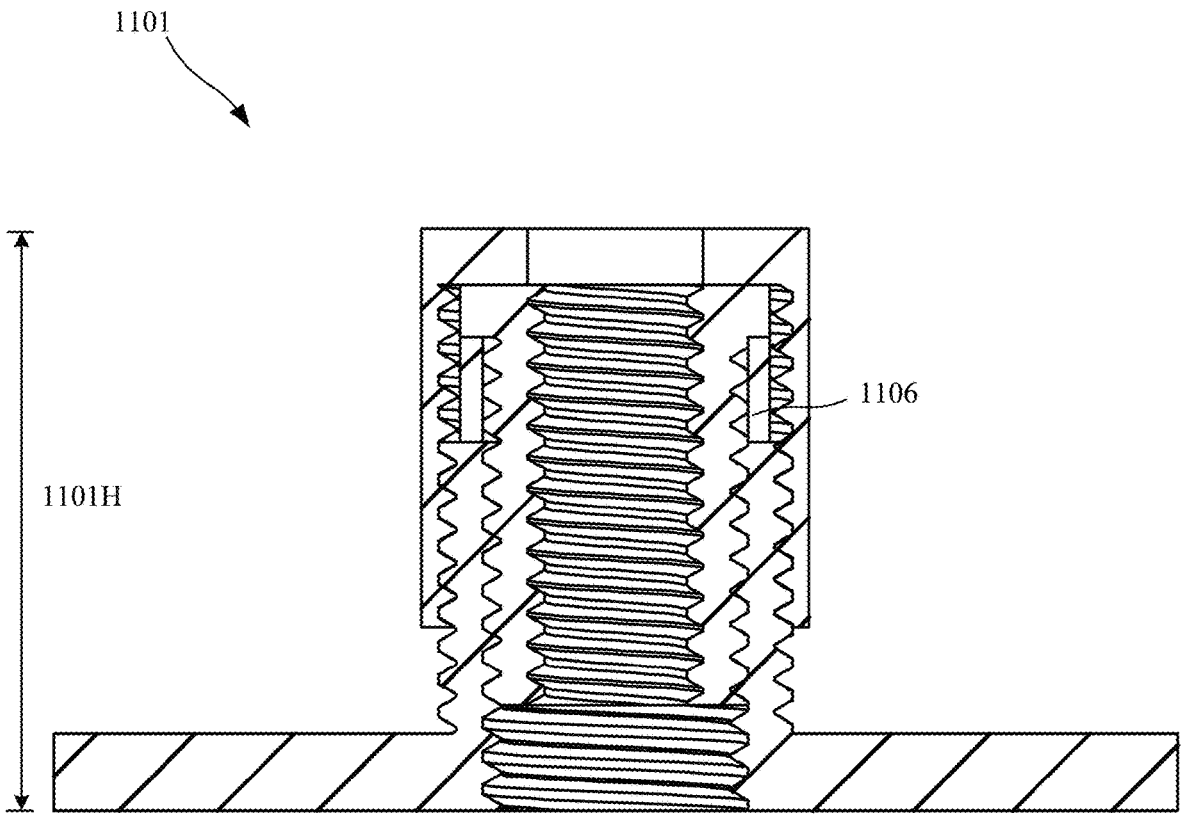
Figure 11C:
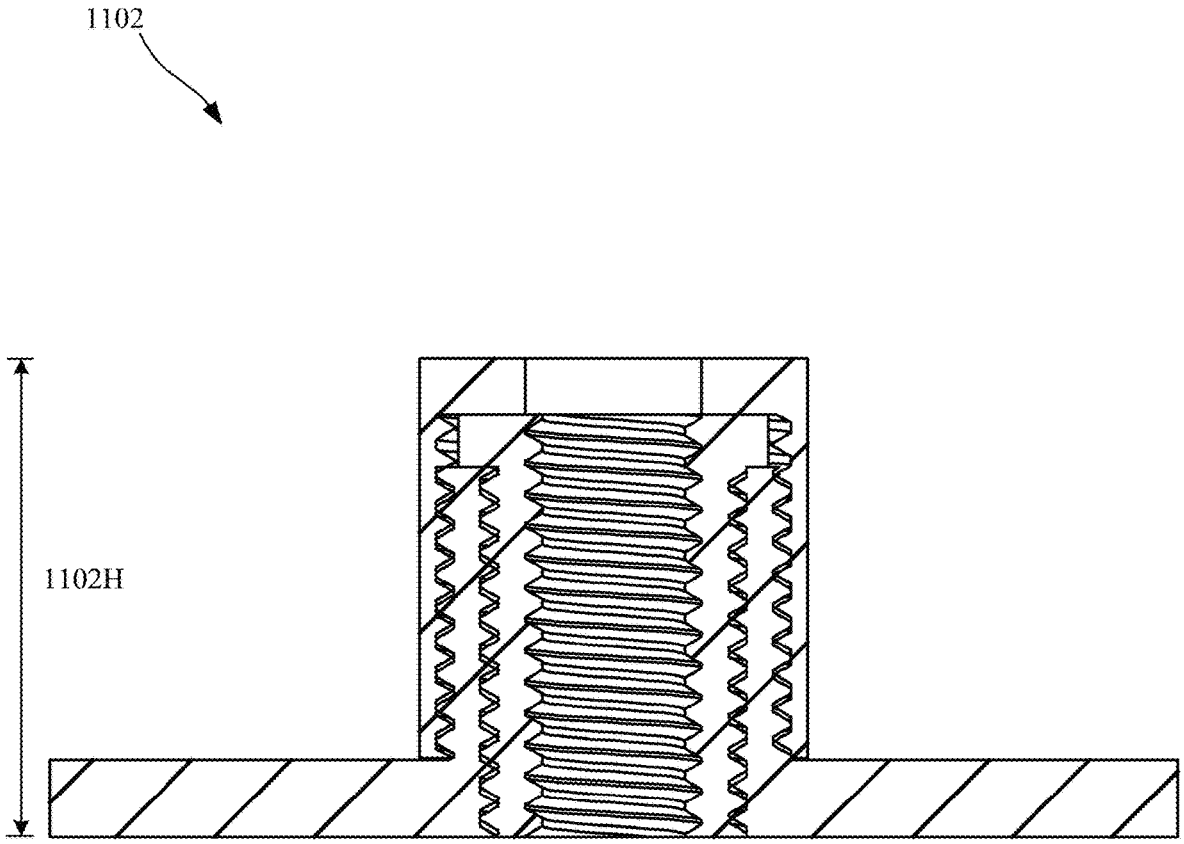

FIG. 11 shows various embodiments of the present invention 1100, 1101, and 1102, which include two spacers, one spacer, and no spacers, respectively. Adding a spacer changes the minimum height of the embodiment. With no spacers installed, for example, embodiment 1102 has a height 1102H of 0.85 inches. With on spacer installed, embodiment 1101 has a height 1101H 1.038 inches. With two spacers installed, embodiment 1100 has a height 1100H of 1.23 inches. As per the discussion above, and as depicted, the spacers are positioned between the top side of the base stem, and the lower portion of the tee stem flange. In this manner, the spacer raises the tee stem relative to the base. This also raises the cap 1104, since the cap sits atop the tee stem flange 1105. The spacers 1106 are useful for controlling the height of the cap 1104 relative to the surface of an artificial mat, for example. In some embodiments it is preferable that the cap 1104 remain under the surface level of the artificial mat, protecting the cap from being struck directly. If the cap 1104 is too low, however, the tee may be more prone to sheering, and may be more difficult to insert. Spacers 1106 can be added or removed to accommodate artificial mats of varying thicknesses. For example, when arriving at a driving range, a user can lift the artificial mat, and place the system 1100 through a hole in the artificial mat. When the mat is placed back onto the ground, the user may find that the cap is resting well below the surface of the mat. The user may then lift the mat, remove the system 1100, remove the cap 1104 and the tee stem 1105 and insert one spacer 1106 to arrive at system 1101 or two spacers to arrive at 1100. The assembly is reconfigured by sliding the spacer over the threaded portion of the tee stem, and then reassembling the tee stem into the base, and the cap over the tee stem.

In an additional embodiment of the present invention, an anchor, such as those described above, may be integrated directly into a practice mat. In this manner, a driving range operator, or other consumer, could purchase a practice mat with an anchor already installed, and would only need to purchase the corresponding tee portion in order to provide further adjustment. In this embodiment, the anchor portion may differ from those described above, by way of being integrated, such that the mat has the threaded component integrated into it. These threaded locations may be located at multiple points around the mat, each capable of accepting a tee.

Figure 12A:
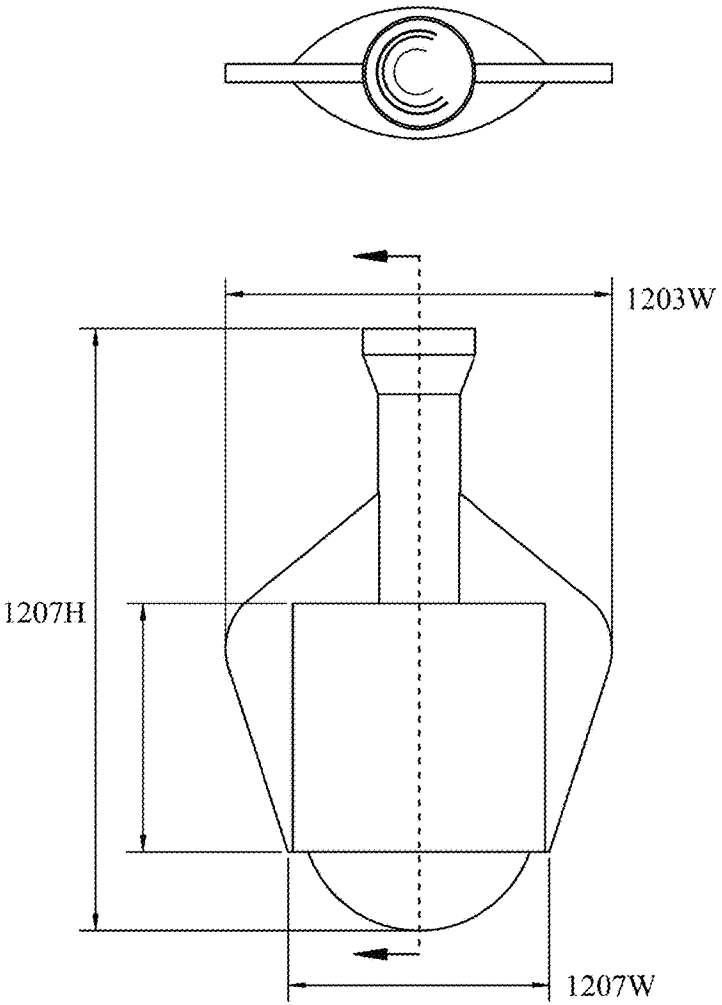
FIG. 12A-C illustrate an example of an installation tool.
Figure 12B:
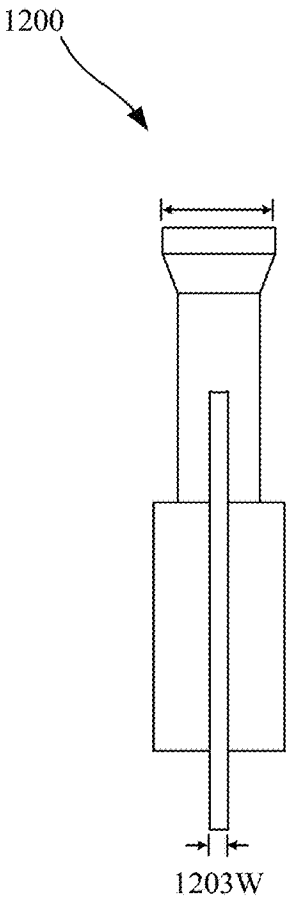
Figure 12C:
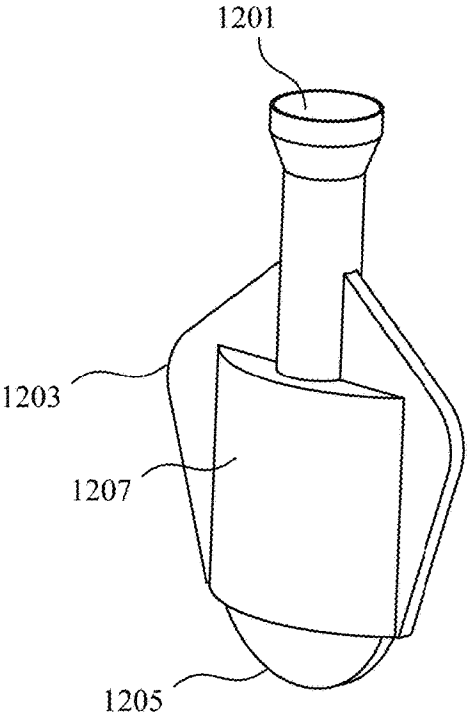

FIG. 12A-C shows a grass anchor installation tool 1200 according to an embodiment of the present invention. The tool 1200 is designed to engage with the various grass anchors described above, including 200, 300, 600, and 700. When installing a grass anchor using a simple means, a coin for example, it may be difficult for a user to quickly discern the precise angle of insertion.

In this manner, once a tee is screwed into the anchor, the user may realize that the anchor was installed at an inconvenient or unwanted angle. The presently described tool solves this problem.

Figure 13A:
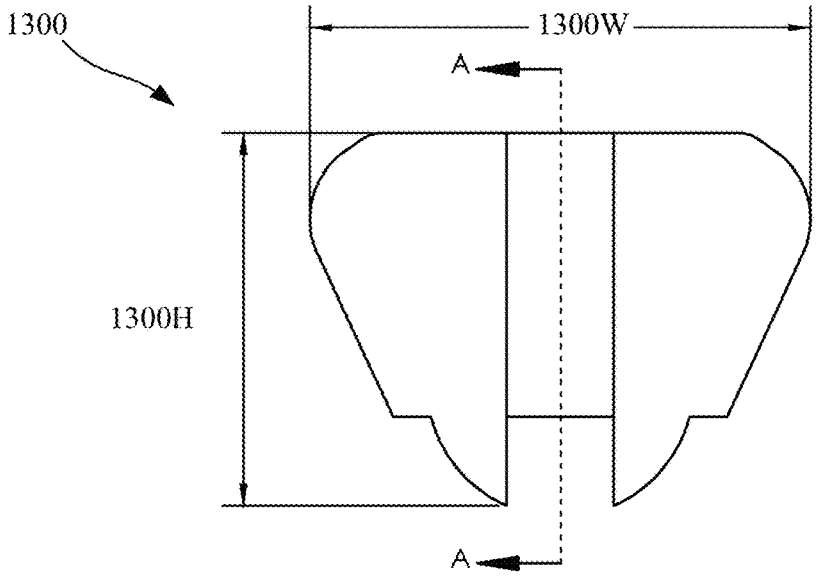
FIG. 13A-C illustrate and example of an installation tool.
Figure 13B:
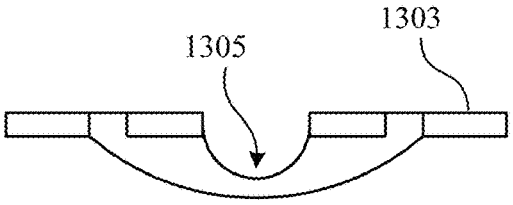
Figure 13C:
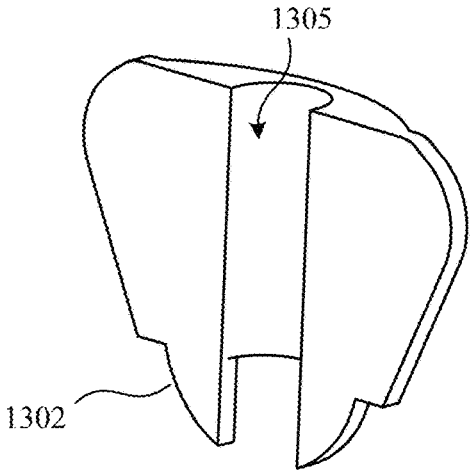

Installation tool 1200 is a single piece tool. The tool has a lower radius 1205 which is configured to precisely engage the upper cap (removable or non-removable) of the various grass anchors described herein. The lower radius 1205 may take many shapes, for example, it may include two separate portions, arranged as prongs, as shown in FIG. 13 for example, along the radius, such that the prongs may also be used as a traditional pitch mark repair tool.

According to various embodiments, the tool 1200 is tall enough to quickly indicate whether the anchor is being driven into the ground in a square fashion. In a preferred embodiment, the tool has a height 1200H of about 2.30 inches. In additional examples the tool is between 1.5 and 3.5 inches tall. Other heights are possible and within the scope of the invention. The width 1207W at the base of the pads 1207 is about 1 inch. In alternative embodiments, with width between 0.5 inches and 3 inches. The height of the pad is depicted as around 0.95 inches. The height of the pad may vary greatly depending on the embodiment of the invention. For example, in at least one embodiment, the central tee portion 1201 may simply have the radium portion 1205 at its base.

As shown, the tool includes wings 1203 extending away from the central spine of the tool 1200. The wings provide sufficient grip for the user to spin the anchor into the ground. The width of the wings provides additional leverage. In various embodiments of the present invention, the width of the tool 1203W, from wing to wing, is about 1.5 inches. In additional examples, the wings may be narrower or wider, for example, from 1 inch to 2.5 inches. In further embodiments, the wings may not exist at all, and the center of the tool may be cylindrical in nature. In various embodiments the thickness 1203T of the wing 1203 is about 0.7 inches. This thickness may increase or decrease depending on the corresponding cap and slot arrangement. According to the present embodiment, pads 1207 extend away from the central spine of the tool at points perpendicular to the wings. These pads provide increased comfort and ergonomic support to the user.

The top section 1201 of the tool 1200 may resemble a tee, or include any other type of direction indicator, such that the user is quickly aware of whether the anchor is being installed square. For example, according to the tool 1200, when installing an anchor, a user can reference the tee portion 1201 which extends opposite the anchor, to determine whether the anchor is being installed square. If it is not, the upper tee portion will be positioned in a manner other than perpendicular to the ground. In some embodiments both the tool 1200 and the anchor cap may be magnetic, such that the tool 1200 is attracted to the anchor, making it easier to position as the user goes to place the anchor into the ground.

Tool 1200 is designed to work in conjunction with various embodiments of the anchor system described herein, and may form a component of a system including those grass anchor systems.

FIG. 13 shows an installation tool 1300 according to an embodiment of the present invention. It is a desire of the anchor system described above to enable a user to maintain consistent tee height independent of where the user inserts the anchor. To accomplish this, it can be preferable that the tee remains inserted into the anchor portion at a fixed height, and then the anchor and tee system is simply transferred from one location to another, for example one tee box to the next, or a driving range to the course. In order to ease the insertion of the anchor and tee system, without disturbing the height of the tee, a user may utilize instillation tool 1300.

Installation tool 1300 is configured to engage the cap (non-removable or removable) of an anchor, to allow a user to spin the anchor into or out of the ground. To accomplish this, the tool 1300 has twin barbs 1302 at the lower distal end. These barbs are configured to match the radius of the cap portion of an anchor. In various embodiments, the barbs may be shaped to allow use as a ball mark repair tool.

The installation tool 1300 is further configured with a central channel 1305. The central channel 1305 is positioned outside of the central plane A of the barbs. This allows the tool 1300 to wrap around a tee, by placing the tee into the channel 1305, such that the tee does not impede access to the cap. In this manner, the tool 1300 can engage the cap portion of an anchor, and be used to install and uninstall the anchor into the ground, without disturbing the tee height.

The tool 1300, as shown, also includes wings 1303 on either side. The wings 1303 provide ergonomic support to the user's hand and increase leverage between the user and the tool when the user is installing or uninstalling an anchor. The tool may also be used to remove a removable cap, where so equipped.

According to various embodiments, the tool 1300 has a height 1300H of about 1.12 inches. The tool may be taller or shorter, for example, 0.5" to 2.5" depending on the use case and user. The width 1300W of the wings 1303 may be about 1.5 inches from end to end. In various embodiments the tool may be much narrower, for example. 0.5 inches wide, with little to nonexistent wings, or up to 2.5" wide. Extra width would provide increased leverage for users requiring additional assistance.

FIG. 14 shows five different (1400-1404) tee embodiments according to the present invention. The five embodiments depict different heights and thread heights. As shown, in various embodiments, the threaded portion may not extend all the way up the tee. 1400 has a specification of A=0.375 inches, B=1 inch, and C=1.375 inches. 1401 has a specification of C=2.125 inches, B=1.50 inches. 1402 has a specification of C=2.875 inches and B=1.50 inches. 1403 has a specification of C=3.625 inches and B=1.50 inches. 1403 has a specification of C=4 inches, B=2.0 inches, $C_w$=0.44 inches, $C_H$=0.10 inches, W=0.25 inches, TPI=5/16-18, and a Rad of 220 degrees at the lower tip. In each instances, the specification are merely exemplary. Any component of one or more tees may change, for example, to be made thicker or thinner to accommodate the thread pitch of an anchor system, or to include more or less threaded portion.

Though certain elements, aspects, components or the like are described in relation to one embodiment or example of an adjustable golf tee system, those elements, aspects, components or the like can be included with other embodiments or examples of a golf tee and golf tee installation system, such as when it desirous or advantageous to do so.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific embodiments or examples are presented by way of examples for purposes of illustration and description. They are not intended to be exhaustive of or to limit this disclosure to the precise forms described. Many modifications and variations are possible in view of the above teachings. The embodiments or examples are shown and described in order to best explain the principles of this disclosure and practical applications, to thereby enable others skilled in the art to best utilize this disclosure and various embodiments or examples with various modifications as are suited to the particular use contemplated. It is intended that the scope of this disclosure be defined by the following claims and their equivalents:

What is claimed is:

1. A golf tee anchor system comprising:

a central stem, the central stem having a hollow core, a pointed section extending away from the stem and configured to engage the turf;

a plurality of threads, the threads extending away from the central stem and configured to thread into the turf, a first cap extending from the central stem and opposite the pointed section, the cap having a flat upper surface and having a central opening, a tee portion, comprising an upper surface configured to support a golf ball and a shaft, the shaft extending through the center of the first cap and through the center of the central stem, the central stem configured to accept the shaft within the hollow core, a removable second cap locatable over the top of the first cap, the removable second cap having a central opening.

2. The golf tee system of claim 1, wherein the first cap further includes a pin and wherein the removable second cap further includes a slot configured to engage the pin.

3. The golf tee system of claim 2, wherein the first cap further comprises a recessed channel disposed in the upper surface.

4. The golf tee system of claim 3, wherein the removable second cap further comprises a recessed channel disposed in the upper surface.

5. The golf system of claim 4, further comprising an adjustable ball height comprising a distance from a bottom of the cap to a ball-contacting surface of the head of the tee when the shaft is inserted into the hollow core of the central stem.

6. The golf system of claim 2, wherein the removable second cap is locked into place by engaging the pin.

7. The golf tee system of claim 1, wherein the portion of the central stem forming the hollow core of the central stem includes threads, and wherein the tee includes threads complementary to the threads of the central stem.

8. The golf system of claim 7, wherein the hollow core extends through the entire stem and at least partially into the pointed section.

9. A golf mat adjustable tee system comprising:

a base having a flanged portion;

a base stem extending transversely from the flanged portion, the base stem having exterior threads disposed along its exterior and having interior threads disposed along a hollow interior, a tee mount stem comprising a shaft, and upper surface, and an interior, the tee mount shaft having exterior threads configured to engage the interior threads of the base stem, the interior of the tee mount stem including interior threads, a tee portion, the tee portion having a cupped upper surface and a shaft extending away from the cupped upper surface, the shaft having a threaded portion, the threaded portion configured to engage the interior threads of the tee mount stem, a cap, the cap having a flat upper surface and a hollow interior, the hollow interior having interior threads, the interior threads configured to engage the exterior threads of the base stem.

10. The golf mat adjustable tee system of claim 9, wherein the upper surface of the tee mount stem has a diameter and the tee mount shaft has a diameter and the diameter of the upper surface of the tee mount stem is larger than the diameter of the tee mount stem shaft.

11. The golf mat adjustable tee system of claim 10, further comprising a spacer, wherein the spacer fits over the shaft of the tee mount, and further wherein spacer has an interior diameter and the interior diameter of the spacer is of the same or less than the diameter the upper surface of the tee mount stem.

12. The golf mat adjustable tee system of claim 10, wherein a plurality of spacers engage the upper surface of the tee mount stem, and further wherein the addition of the spacers increases a distance between the flat upper surface of the cap and the base flanged portion.

13. The golf mat adjustable tee system of claim 9, wherein base stem_comprises an outer diameter smaller than a diameter of a golf mat hole, and wherein the base comprises an outer diameter larger than the diameter of the golf hole mat.

14. The golf mat adjustable tee system of claim 9, further comprising an adjustable ball height comprising a distance from a top of the cap to a ball-contacting surface of the cupped portion of the tee when the tee is inserted into the tee mount stem.

15. A golf mat adjustable tee system comprising:

a base having a flanged portion, a base stem extending vertically from the base and perpendicular to the flanged portion, the base stem having a hollow interior and an opening at a upper surface defining an inner diameter, a tee mount stem comprising a shaft, an upper surface, and an interior, the tee mount shaft comprising a smaller diameter than the inner diameter of the opening and hollow interior of the base stem, a tee portion, the tee portion having a cupped upper surface and a shaft extending away from the cupped upper surface, the shaft comprising a smaller diameter than the inner diameter of the interior of the tee mount stem, a cap, the cap having a flat upper surface and a hollow interior, the hollow interior having an inner diameter larger than the outer diameter of the base stem.

16. The golf mat adjustable tee system of claim 15, wherein the base stem comprises an outer diameter smaller than a diameter of a golf mat hole, and wherein the base comprises an outer diameter larger than the diameter of the golf hole mat.

17. The golf mat adjustable tee system of claim 16, further comprising corresponding threaded portions located at the interior of the tee mount stem and the tee portion.

18. The golf mat adjustable tee system of claim 16, further comprising a spacer, wherein the spacer fits over the tee mount stem shaft, and further wherein the interior diameter of the spacer is of the same or less diameter than the upper surface of the tee mount stem.

* * * * *